US009235159B2

(12) United States Patent
Sato

(10) Patent No.: US 9,235,159 B2
(45) Date of Patent: Jan. 12, 2016

(54) DEVELOPER CONVEYING DEVICE AND IMAGE FORMING APPARATUS HAVING A DEVELOPER REMOVING PORTION

(71) Applicant: Oki Data Corporation, Tokyo (JP)

(72) Inventor: Tetsuya Sato, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 14/459,430

(22) Filed: Aug. 14, 2014

(65) Prior Publication Data

US 2015/0050057 A1 Feb. 19, 2015

(30) Foreign Application Priority Data

Aug. 16, 2013 (JP) ..... 2013-169137

(51) Int. Cl.

*G03G 21/00* (2006.01)
*G03G 15/08* (2006.01)
*G03G 21/10* (2006.01)

(52) U.S. Cl.

CPC ..... *G03G 15/0844* (2013.01); *G03G 15/0879* (2013.01); *G03G 15/0891* (2013.01); *G03G 21/105* (2013.01); *G03G 2221/0005* (2013.01)

(58) Field of Classification Search

CPC ..... G03G 15/0844; G03G 2221/0005; G03G 15/0879; G03G 15/0891; G03G 21/105
USPC ..... 399/283, 273
See application file for complete search history.

(56) References Cited

U.S. PATENT DOCUMENTS

| | | | | |
|---|---|---|---|---|
| 6,148,167 | A * | 11/2000 | Komakine et al. |
| 8,190,078 | B2 * | 5/2012 | Tawada |
| 2003/0234262 | A1 * | 12/2003 | Hart |
| 2010/0143011 | A1 | 6/2010 | Tawada |
| 2015/0063887 | A1 * | 3/2015 | Asaoka et al. |
| 2015/0071691 | A1 * | 3/2015 | Fujii |

FOREIGN PATENT DOCUMENTS

| | | | | |
|---|---|---|---|---|
| JP | 61-102677 | A | | 5/1986 |
| JP | 63-100763 | U | | 6/1988 |
| JP | 09-160405 | A | | 6/1997 |
| JP | 2001-042733 | A | | 2/2001 |
| JP | 2001042733 | A | * | 2/2001 |
| JP | 2003140517 | A | * | 5/2003 |
| JP | 2003-228253 | A | | 8/2003 |
| JP | 2006259426 | A | * | 9/2006 |
| JP | 2006-337588 | A | | 12/2006 |
| JP | 2007034340 | A | * | 2/2007 |
| JP | 2008-129210 | A | | 6/2008 |
| JP | 2010-107930 | A | | 5/2010 |
| JP | 2011128317 | A | * | 6/2011 |
| JP | 2013-114225 | A | | 6/2013 |

* cited by examiner

*Primary Examiner* — Susan Lee
(74) *Attorney, Agent, or Firm* — Rabin & Berdo, P.C.

(57) ABSTRACT

A developer conveying device includes a rotatable developer conveying body including a shaft portion and a blade portion provided on the shaft portion for conveying a developer. The developer conveying device further includes a developer removing portion having a developer removing fin that contacts the developer conveying body in a counter direction with respect to a rotating direction of the developer conveying body.

17 Claims, 11 Drawing Sheets

DEVELOPER CONVEYING DEVICE AND IMAGE FORMING APPARATUS HAVING A DEVELOPER REMOVING PORTION

BACKGROUND OF THE INVENTION

The present invention relates to a developer conveying device, and relates to an image forming apparatus such as an electrophotographic printer using the developer conveying device.

In an electrophotographic printer (hereinafter, referred to as a printer), a developer image is formed on a surface of an image bearing body, and is transferred to a surface of a recording medium (i.e., a recording sheet) via an intermediate transfer belt. After the transfer of the developer image, a residual developer may remain on the surface of the image bearing body. A recovery container is provided for recovering such a residual developer. The recovery container has an elongated box shape.

A conveying screw is rotatably provided in the recovery container in such a manner that an axial direction of the conveying screw is parallel to a longitudinal direction of the recovery container. The developer is conveyed by the conveying screw, and is distributed throughout the recovery container.

When the developer adheres to the conveying screw, a capacity (i.e., a conveying capacity) with which the conveying screw conveys the developer may decrease. Therefore, in order to prevent the developer from adhering to the conveying screw, a prevention plate having a plurality of fins is provided so as to contact the conveying screw (see, for example, Patent Document 1).

Patent Document 1: Japanese Laid-open Patent Publication No. 2010-107930 (FIGS. 4 through 9).

In this regard, there is a demand for enhancing the conveying capacity of the developer.

SUMMARY OF THE INVENTION

An aspect of the present invention is intended to suppress a decrease in a conveying capacity of a developer.

According to an aspect of the present invention, there is provided a developer conveying device including a rotatable developer conveying body including a shaft portion and a blade portion provided on the shaft portion for conveying a developer. The developer conveying device further includes a developer removing portion having a developer removing fin that contacts the developer conveying body in a counter direction with respect to a rotating direction of the developer conveying body.

With such a configuration, a decrease in a conveying capacity of a developer by the developer conveying body is suppressed.

According to another aspect of the present invention, there is provided an image forming apparatus including the above described developer conveying device.

DETAILED DESCRIPTION OF THE PREFERRED EMBODIMENT

Hereinafter, the embodiment and modifications of the present invention will be described with reference to the attached drawings.

First Embodiment

Configuration of Color Printer

Figure 1:
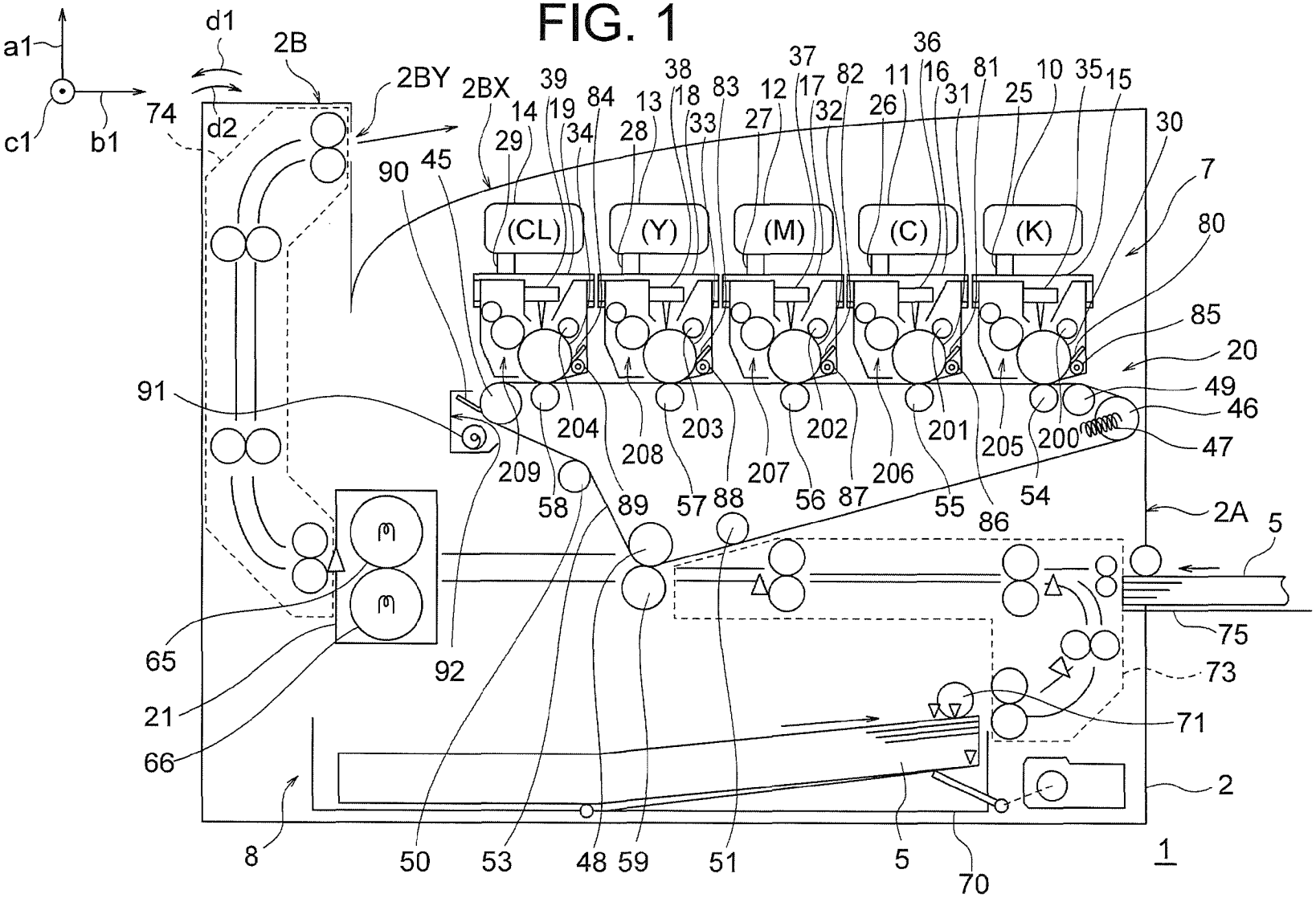
FIG. 1 is a schematic side view showing a configuration of a color printer according to the first the first embodiment of the present invention.

FIG. 1 is a view showing a configuration of a color electrophotographic printer 1 (hereinafter referred to as a printer 1) as an image forming apparatus according to the first embodiment of the present invention. The printer 1 includes, for example, a casing 2 (hereinafter referred to as a printer casing 2) having a substantially box shape. The printer casing 2 has a front surface 2A on a right side in FIG. 1. Hereinafter, in a state where a viewer faces the front surface 2A of the printer casing 2, an upward direction shown by an arrow al in FIG. 1 is referred to as a printer upward direction. A direction opposite to the printer upward direction is referred to as a printer downward direction. The printer upward direction and the printer downward direction are collectively referred to as a printer vertical direction. Further, in a state where the viewer faces the front surface 2A of the printer casing 2, a front direction shown by an arrow b1 in FIG. 1 is referred to as a printer front direction. A direction opposite to the printer front direction is referred to as a printer rear direction. The printer front direction and the printer rear direction are collectively referred to as a printer front-rear direction. Further, in a state where the viewer faces the front surface 2A of the printer casing 2, a left direction shown by an arrow c1 in FIG. 1 is referred to as a printer left direction. A direction opposite to the printer left direction is referred to as a printer right direction. The printer left direction and the printer right direction are collectively referred to as a printer left-right direction.

The printer casing 2 has a top surface 2B. A recess 2BX (hereinafter referred to as a medium placing portion 2BX) is provided on a rear part of the top surface 2B. The medium placing portion 2BX is provided for placing a recording medium 5 (i.e., a recording sheet) having a rectangular shape on which an image is formed, so that a user can take the recording medium 5 from the medium placing portion 2BX. A medium ejection opening 2BY is provided on a rear wall facing the medium placing portion 2BX. The medium ejection opening 2BY is provided for ejecting the recording medium 5 to the medium placing portion 2BX. Further, a door (not shown) is openably provided on, for example, a left end portion of the printer casing 2.

An image forming section 7 is provided in the printer casing 2. The image forming section 7 is located in a region ranging from a center part to an upper part of the printer casing 2. The image forming section 7 is configured to form (i.e., print) a color image on a surface of the recording medium 5. A recording medium feeding unit 8 (hereinafter referred to as a feeding unit 8) is provided on a lower part of the printer casing 2. The feeding unit 8 is configured to feed the recording medium 5 to the image forming section 7 for image formation.

The image forming section 7 includes five toner cartridges. To be more specific, the image forming section 7 includes first, second, third and fourth toner cartridges 10, 11, 12 and 13 that respectively store toners of black (K), cyan (C), magenta (M) and yellow (Y) as basic colors for image formation. The image forming section 7 further includes a fifth toner cartridge 14 that stores a toner of clear (CL) as a special color. The image forming section 7 further includes five image forming units. To be more specific, the image forming section 7 includes first, second, third, fourth and fifth image forming units 15, 16, 17, 18 and 19 that form toner images (i.e., developer images) using toners supplied by the toner cartridges 10, 11, 12, 13 and 14. The image forming section further includes a transfer unit 20 that transfers the toner images from the image forming units 15, 16, 17, 18 and 19 to a surface of the recording medium 5, and a fixing unit 21 that fixes the toner image (including five colors) to the surface of the recording medium 5.

The first through fifth toner cartridges 10, 11, 12, 13 and 14 of black (K), magenta (M), cyan (C), yellow (Y) and clear (CL) are provided on the upper part of the printer casing 2, and are arranged in this order from a front side toward a rear side of the printer casing 2 at predetermined constant intervals. The first through fifth image forming units 15, 16, 17, 18 and 19 are provided respectively below the first through fifth toner cartridges 10, 11, 12, 13 and 14, and are arranged from the front side toward the rear side of the printer casing 2 at predetermine constant intervals. The first through fifth image forming units 15, 16, 17, 18 and 19 respectively have unit frames having substantially elongated rectangular box shape. Longitudinal directions of the unit frames are parallel to the printer left-right direction. First, second, third, fourth and fifth toner supply tubes 25, 26, 27, 28 and 29 are provided respectively between the first through fifth image forming units 15, 16, 17, 18 and 19 and the first through fifth toner cartridges 10, 11, 12, 13 and 14. The first through fifth image forming units 15, 16, 17, 18 and 19 and the first through fifth toner cartridges 10, 11, 12, 13 and 14 are connected with each other via first, second, third, fourth and fifth toner supply tubes 25, 26, 27, 28 and 29.

The first through fifth image forming units 15, 16, 17, 18 and 19 include photosensitive drums 30, 31, 32, 33 and 34 (image bearing bodies) that respectively rotate in a first rotating direction shown by an arrow d1 in FIG. 1 (hereinafter, referred to as a first rotating direction d1) about drum rotation axes parallel to the printer left-right direction. The first through fifth image forming units 15, 16, 17, 18 and 19 further include charging rollers (i.e., charging members) 200, 201, 202, 203 and 204 that uniformly charge surfaces of photosensitive drums 30, 31, 32, 33 and 34. The charging rollers 200, 201, 202, 203 and 204 respectively contact the surfaces of the photosensitive drums 30, 31, 32, 33 and 34, and rotate following rotations of the photosensitive drums 30, 31, 32, 33 and 34. Exposure heads 35, 36, 37, 38 and 39 are provided so as to face the surfaces of the photosensitive drums 30, 31, 32, 33 and 34 from above. The exposure heads 35, 36, 37, 38 and 39 emit light to expose the surfaces of photosensitive drums 30, 31, 32, 33 and 34 to form latent images (from which toner images are to be formed). Developing units 205, 206, 207, 208 and 209 are provided so as to face the surfaces of the photosensitive drums 30, 31, 32, 33 and 34. The developing units 205, 206, 207, 208 and 209 includes developing rollers (i.e., developer bearing bodies) rotatable in a direction shown by an arrow d2 (hereinafter referred to as a second rotating direction d2), and toner supply rollers (i.e., developer supply members) rotatable in the second rotating direction d2. The first through fifth image forming units 15, 16, 17, 18 and 19 form toner images on the surfaces of the photosensitive drums 30, 31, 32, 33 and 34 using the toners supplied from the first through fifth toner cartridges 10, 11, 12, 13 and 14 via the first through fifth toner supply tubes 25, 26, 27, 28 and 29.

The transfer unit 20 has a unit frame as described later, and is detachably mounted in the printer casing 2. In a state where the door of the printer casing 2 is opened, the transfer unit 20 is inserted into the printer casing 2 from the left, and is pulled out from the printer casing 2 to the left. In a state where the transfer unit 20 is mounted in the printer casing 2, the transfer unit 20 is located below and in the vicinity of the first to fifth image forming units 15, 16, 17, 18 and 19. The transfer unit 20 includes a driving roller 45 at a predetermined position substantially below the fifth image forming unit 19. The driving roller 45 is provided for driving an endless transfer belt 53 (i.e., an intermediate transfer belt). The driving roller 45 is rotatably supported by the unit frame, and rotates in the second rotating direction d2 (opposite to the first rotating direction d1) about a rotation axis parallel to the printer left-right direction. The transfer unit 20 further includes a tension roller 46 at a predetermined position substantially below the first image forming unit 15. The tension roller 46 is supported by the unit frame, and is rotatable in the second rotating direction d2 about a rotation shaft (i.e., a rotation axis) parallel to the printer left-right direction. Left and right ends of the rotation shaft of the tension roller 46 are biased frontward by compression coil springs 47. The transfer unit 20 further includes a backup roller 48 provided at a predetermined position lower than the driving roller 45 and the tension roller 46. The backup roller is supported by the unit frame, and is rotatable in the second rotating direction d2 about a rotation axis parallel to the printer left-right direction. The transfer unit 20 further includes driven rollers 49, 50 and 51 supported by the unit frame, and are rotatable about rotation axes parallel to the printer left-right direction. The driven roller 49 is provided at a predetermined position in the vicinity of the tension roller 46. The driven roller 50 is provided at a predetermined position between the driving roller 45 and the backup roller 48. The driven roller 51 is provided at a predetermined position between the tension roller 46 and the backup roller 48. The endless transfer belt 53 is stretched around the driving roller 45, the tension roller 46, the backup roller 48, and the driven rollers 49, 50 and 51 so as to form a substantially triangular shape.

The transfer unit 20 further includes primary transfer rollers 54, 55, 56, 57 and 58 (i.e., primary transfer members) provided inside the transfer belt 53. The primary transfer rollers 54, 55, 56, 57 and 58 are supported by the unit frame, and are rotatable in the second rotating direction d2 about rotation axes parallel to the printer left-right direction. Upper parts of surfaces of the primary transfer rollers 54, 55, 56, 57 and 58 are pressed against lower parts of surfaces of the photosensitive drums 30, 31, 32, 33 and 34 via the transfer belt 53.

The transfer unit 20 further includes a secondary transfer roller 59 (i.e., a secondary transfer member) below the backup roller 48. The secondary transfer roller 59 is provided for transferring the toner image from a surface of the transfer belt 53 to the surface of the recording medium 5. The secondary transfer roller 59 is supported by the unit frame, and is rotatable in the first rotating direction d1 about a rotation axis parallel to the printer left-right direction. In this regard, the secondary transfer roller 59 is provided in the printer casing 2. In a state where the transfer unit 20 is mounted in the printer casing 2, an upper part of a surface of the secondary transfer roller 59 is pressed against a lower part of a surface of the backup roller 48.

The fixing unit 21 has a unit frame having a substantially rectangular box shape and having a relatively long predetermined length. The fixing unit 21 is provided on a rear side of the secondary transfer roller 59 and the backup roller 48 of the transfer unit 20. The fixing unit 21 includes, for example, a heating roller 65 having an internal heater. The heating roller 65 is supported by the unit frame, and is rotatable in the second rotating direction d2 about a rotation axis parallel to the printer left-right direction. The fixing unit 21 further includes, for example, a pressure roller 66 having an internal heater. The pressure roller 66 is supported by the unit frame, and is rotatable in the first rotating direction d1 about a rotation axis parallel to the printer left-right direction. An upper part of a surface of the pressure roller 66 is pressed against a lower part of a surface of the heating roller 65 with a predetermined pressing force.

The feeding unit 8 includes a feeding tray 70 storing a plurality of recording media 5 (i.e., recording sheets). The recording media 5 is stored in the feeding tray 70 in such an orientation that, for example, a longitudinal direction of the recording medium 5 is parallel to the printer front-rear direction. The feeding unit 8 include a pickup roller 71 for feeding the recording medium 5 one by one from the feeding tray 70. The pickup roller 71 is rotatable in the first rotating direction d1 about a rotation axis parallel to the printer left-right direction.

A transport section 73 (hereinafter referred to as a feeding transport section 73) is provided in the printer casing 2 for transporting the recording medium 5 to the image forming section 7. The feeding transport section 73 extends from an obliquely upper portion of the feeding tray 70, and reaches the front vicinity of the secondary transfer roller 59 and the backup roller 48. The feeding transport section 73 forms a transport path (hereinafter referred to as a feeding transport path) along which the recording medium 5 is transported by components (i.e., transport path components) such as a plurality of transport rollers, transport guides and a transport motor.

Further, a transport section 74 (hereinafter referred to as an ejection transport section 74) is provided in the printer casing 2 for transporting the recording medium 5 (on which the toner image has been printed) to the medium ejection opening 2BY. The ejection transport section 74 extends from the rear vicinity of the fixing unit 21 to reach the vicinity of the medium ejection opening 2BY. The ejection transport section 74 forms a transport path (hereinafter referred to as an ejection transport path) along which the recording medium 5 is transported by components (i.e., transport path components) such as a plurality of transport rollers, transport guides and a transport motor.

The printer casing 2 further includes a manual feeding tray 75 provided at a predetermined position on the front surface 2A. The recording medium 5 may be fed from the manual feeding tray 75 to the image forming section 7 via the feeding transport path.

A control unit (not shown) such as a microcomputer is provided in the printer casing 2. The control unit controls an entire operation of the color printer 1. The control unit is connected to a host device (not shown) such as a personal computer using wired or wireless communication system. The host device sends instruction to the color printer 1 to print a color image (i.e., a printing object). Therefore, when the control unit receives image data (corresponding to the color image) from the host device and receives instruction to print the color image, the control unit performs image forming processing to form (print) the color image on the surface of the recording medium 5.

When the control unit starts the image forming processing, the control unit drives respective motors (i.e., drum motors) for driving the image forming units 15, 16, 17, 18 and 19. When the drum motors are driven, the photosensitive drums 30, 31, 32, 33 and 34 rotate in the first rotating direction d1, and the developing rollers and the supply rollers of the developing units 205, 206, 207, 208 and 209 rotate in the second rotating direction d2. The charging roller 201, 202, 203, 204 and 205 rotate following the rotation of the photosensitive drums 30, 31, 32, 33 and 34. Further, the control unit causes predetermined voltage sources to apply predetermined voltages to respective rollers (i.e., the charging rollers 200, 201, 202, 203 and 204, the developing rollers and the supply rollers) of the image forming units 15, 16, 17, 18 and 19 for image formation. The control unit further drives a driving motor (hereinafter referred to as a unit driving motor) for driving the transfer unit 20. When the unit drive motor is driven, the driving roller 45 of the transfer unit 20 rotates in the second rotating direction d2. As the driving roller 45 rotates, the tension roller 46, the backup roller 48, the driven rollers 49, 50 and 51 and the transfer belt 53 also rotate in the second rotating direction d2 following the rotation of the driving roller 45. Further, the control unit causes predetermined voltage sources to apply predetermined voltages to the primary transfer rollers 54, 55, 56, 57 and 58 and the secondary transfer roller 59 for transfer of toner images. Furthermore, the control unit causes a heater power source to apply current to the heaters of the fixing unit 21 so as to heat the heating roller 65 and the pressure roller 66. Moreover, the control unit drives a predetermined motor (i.e., a fixing motor) for driving the fixing unit 21 to cause the heating roller 65 to rotate in the second rotating direction d2 and cause the pressure roller 66 to rotate in the first direction d1. In this state, the control unit drives the feeding transport section 73 and the ejection transport section 74 using the transport motors. Then, the control unit causes the pickup roller 71 to rotate in the first rotating direction d1 using a predetermined motor. The pickup roller 71 feeds the recording medium 5 one by one from the feeding tray 70. The recording medium 5 is transported by the feeding transport section 73 along the feeding transport path to reach the image forming section 7. The control unit controls the exposure heads 35, 36, 37, 38 and 39 to emit light based on image data sent from the host device. The exposure heads 35, 36, 37, 38 and 39 emit light to expose the surface of the photosensitive drums 30, 31, 32, 33 and 34 so as to form latent images. The latent images on the photosensitive drums 30, 31, 32, 33 and 34 are developed by the developing units 205, 206, 207, 208 and 209 using respective toners so that toner images (i.e., developer images) are formed on the photosensitive drums 30, 31, 32, 33 and 34. The toner images are transferred from the photosensitive drums 30, 31, 32, 33 and 34 to the transfer belt 53 in a superimposed manner by the primary transfer rollers 55, 56, 57, 58 and 59.

The recording medium 5 transported by the feeding transport section 73 reaches the secondary transfer roller 59, and is further transported in such a manner that the recording medium 5 is nipped between the transfer belt 53 and the secondary transfer roller 59. In this state, the toner image is transferred from the transfer belt 53 to the surface of the recording medium 5. The recording medium 5 is further transported to the fixing unit 21. In the fixing unit 21, the recording medium 5 is nipped between the heating roller 65 and the pressure roller 66, and is transported. The recording medium 5 is applied with heat and pressure by the heating roller 65 and the pressure roller 66, and the toner image melts and is fixed to the recording medium 5. That is, a color toner image is formed on the recording medium 5. The ejection transport section 74 transports the recording medium 5 with the color toner image along the ejection transport path to the medium ejection opening 2BY. The recording medium 5 is ejected through the medium ejection opening 2BY, and is placed on the medium placing portion 2BX. The user can take the recording medium 5 with the color toner image from the medium placing portion 2BX.

In this regard, the first through fifth image forming units 15, 16, 17, 18 and 19 include cleaning blades 80, 81, 82, 83 and 84 for removing toners remaining on the surfaces of the photosensitive drums 30, 31, 32, 33 and 34 after transfer of the toner images to the transfer belt 53. The cleaning blades 80, 81, 82, 83 and 84 have substantially strip shapes. The first through fifth image forming units 15, 16, 17, 18 and 19 further include toner conveying bodies 85, 86, 87, 88 and 89 for conveying toners (hereinafter referred to waste toners) removed from the surfaces of the photosensitive drums 30, 31, 32, 33 and 34 by the cleaning blades 80, 81, 82, 83 and 84.

Each of the toner conveying bodies 85, 86, 87, 88 and 89 includes a shaft portion and a blade portion formed integrally on the shaft portion. The shaft portion has a cylindrical shape and has a predetermined length. The blade portion has a spiral shape, and extends from an end portion to the other end portion of the shaft portion in a longitudinal direction of the shaft portion. The cleaning blades 80, 81, 82, 83 and 84 are located on front bottom portions of the respective unit frames of the first through fifth image forming units 15, 16, 17, 18 and 19 in such an orientation that the longitudinal directions of the cleaning blades 80, 81, 82, 83 and 84 are parallel to the printer left-right direction. Edge portions of the cleaning blades 80, 81, 82, 83 and 84 in a transverse direction thereof are oriented obliquely rearward and downward, and are pressed against front parts of surfaces of the photosensitive drums 30, 31, 32, 33 and 34. The first through fifth image forming units 15, 16, 17, 18 and 19 respectively include toner conveying paths (hereinafter referred to as toner-ejection-conveying paths) provided at obliquely lower front portions with respect to the cleaning blade 80, 81, 82, 83 and 84. The toner-ejection-conveying paths have groove shapes, and extend in the printer left-right direction. The toner-ejection-conveying paths are used for conveying the waste toner from the first through fifth image forming units 15, 16, 17, 18 and 19. The toner conveying bodies 85, 86, 87, 88 and 89 are supported by the respective unit frames of the first through fifth image forming units 15, 16, 17, 18 and 19. The toner conveying bodies 85, 86, 87, 88 and 89 are rotatable in the second rotating direction d2 about the shaft portions parallel to the printer left-right direction. The blade portions of the toner conveying bodies 85, 86, 87, 88 and 89 are respectively housed in the toner-ejection-conveying paths. The toner conveying bodies 85, 86, 87, 88 and 89 are linked with the photosensitive drums 30, 31, 32, 33 and 34 via an even number of gears respectively so as to convert the rotations of the photosensitive drums 30, 31, 32, 33 and 34 in the first rotating direction d1 to the rotations of the toner conveying bodies 85, 86, 87, 88 and 89 in the second rotating direction d2.

In the first through fifth image forming units 15, 16, 17, 18 and 19, after the respective toner images are transferred from the photosensitive drums 30, 31, 32, 33 and 34 to the transfer belt 53, the cleaning blades 80, 81, 82, 83 and 84 scrape off the residual toners from the front parts of the surfaces of the photosensitive drums 30, 31, 32, 33 and 34 (i.e., parts from which the toner images have been transferred to the transfer belt 53). The waste toners scraped off from the photosensitive drums 30, 31, 32, 33 and 34 fall into the toner-ejection-conveying paths. The toner conveying bodies 85, 86, 87, 88 and 89 rotate in the second rotating direction d2, and the blade portions of the toner conveying bodies 85, 86, 87, 88 and 89 convey the waste toners through the toner-ejection-conveying paths to the printer right direction.

The transfer unit 20 includes a cleaning blade 90 for removing the residual toner from the transfer belt 53 after the transfer of the toner image from the surface of the transfer belt 53 to the surface of the recording medium 5. The cleaning blade 90 has a substantially strip shape. The transfer unit 20 further includes a toner conveying body 91 that conveys the toner (i.e., the waste toner) removed from the surface of the transfer belt 53 by the cleaning blade 90. The toner conveying body 91 of the transfer unit 20 has, for example, the same structure as the toner conveying bodies 85, 86, 87, 88 and 89 of the first through fifth image forming units 15, 16, 17, 18 and 19. The transfer unit 20 includes a toner conveying path 92 (hereinafter referred to as a toner-ejection-conveying path 92) provided at a rear side of the driving roller 45 in the unit frame. The cleaning blade 90 is housed in the toner-ejection-conveying path 92 in such an orientation that the longitudinal direction of the cleaning blade 90 is parallel to the printer left-right direction. An edge of the cleaning blade 90 in a transverse direction is oriented obliquely frontward and downward, and is pressed against a rear part of the surface of the transfer belt 53.

The toner conveying body 91 is supported by the unit frame. The toner conveying body 91 is rotatable in the second rotating direction d2 about a shaft portion parallel to the printer left-right direction. A blade portion of the toner conveying body 91 is housed in the toner-ejection-conveying path 92. The toner conveying body 91 is linked with the driving roller 45 via an odd number of gears, so that the rotation of the driving roller 45 in the second rotating direction d2 is transmitted to the rotation of the toner conveying body 91 in the second rotating direction d2. With such a configuration, after the toner image is transferred from the transfer belt 53 to the recording medium 5, the cleaning blade 91 scrapes off the residual toner from the rear part of the surface of the transfer belt 53 (i.e., a part from which the toner image has been transferred to the recording medium 5). The waste toner scraped off from the transfer belt 53 falls into the toner-ejection-conveying path 92. The toner conveying body 91 rotates in the second rotating direction d2, and the blade portion of the toner conveying body 91 conveys the waste toners through the toner-ejection-conveying path 92 to the printer right direction. The transfer unit 20 further includes a toner conveying/recovery section that conveys and recovers the waste toner having been conveyed by the toner conveying bodies 85, 86, 87, 88 and 89 of the first through fifth image forming units 15, 16, 17, 18 and 19 and the waste toner having been conveyed by the toner conveying body 91.

<Configuration of Transfer Unit>

Figure 2:
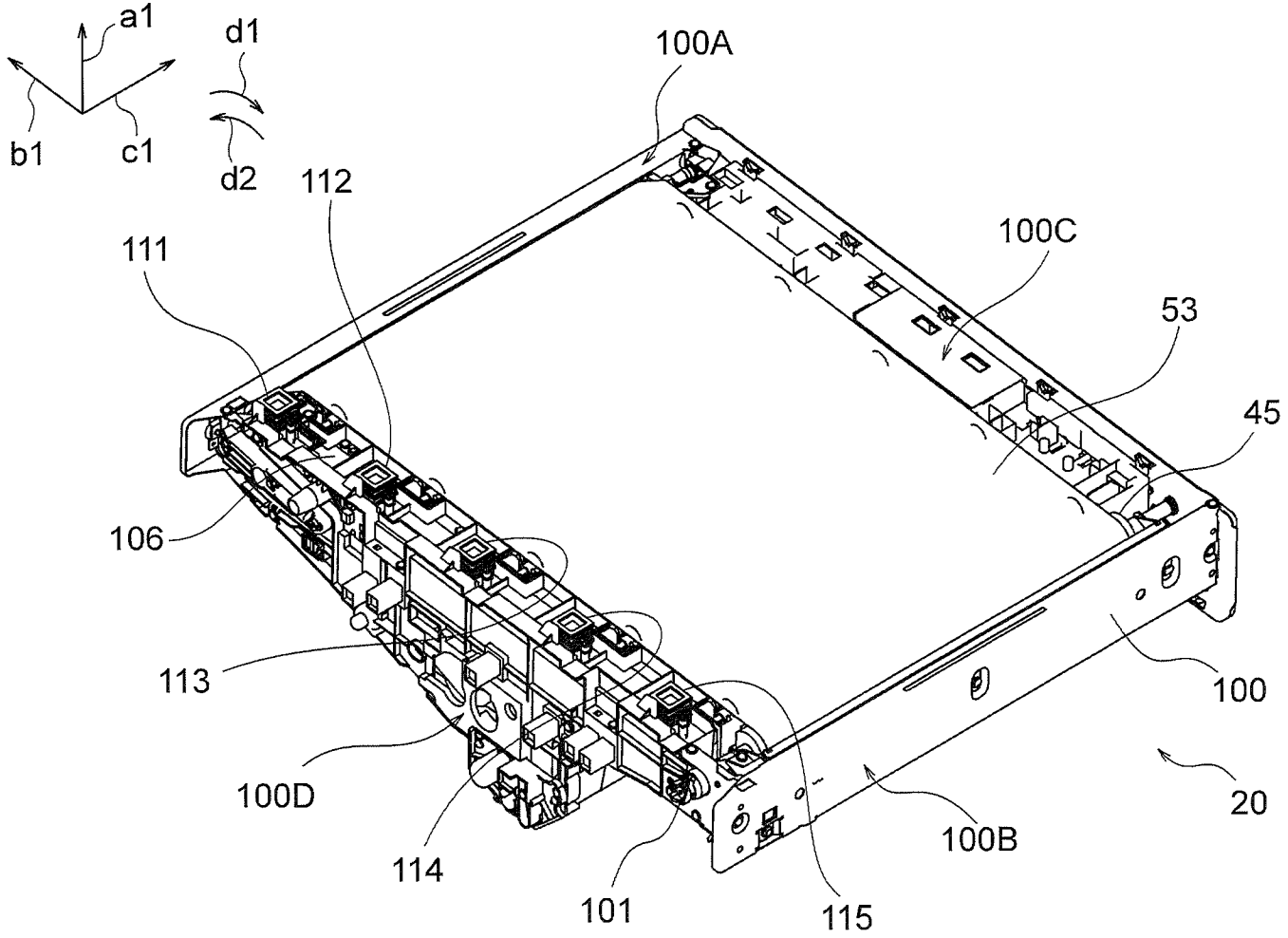
FIG. 2 is a perspective view showing a configuration of a transfer unit of the color printer according to the first embodiment.

Description will be made of a configuration of the transfer unit 20 along with a configuration of the toner conveying/recovery section provided on the transfer unit 20. FIG. 2 is a perspective view showing a configuration of the transfer unit 20 of the first embodiment. As shown in FIG. 2, the transfer unit 20 includes a unit frame 100. The unit frame 100 includes a front frame 100A and a rear frame 100B each of which having a substantially box shape elongated in the printer left-right direction. The unit frame 100 further includes a left side frame 100C and a right side frame 100D each of which is elongated in the printer front-rear direction and has a substantially reverse triangular shape. A left end portion of the front frame 100A is joined to a front end portion of the left side frame 100C, and a right end portion of the front frame 100A is joined to a front end portion of the right side frame 100D. A left end portion of the rear frame 100B is joined to a rear end portion of the left side frame 100C, and a right end portion of the rear frame 100B is joined to a rear end portion of the right side frame 100D. The front frame 100A, the rear frame 100B, the left side frame 100C and the right side frame 100D of the unit frame 100 of the transfer unit 20 entirely form a rectangular frame-like shape. Hereinafter, a left surface of the left side frame 100C is referred to as a left-frame-side surface, and a right surface of the left side frame 100C is referred to as a left-frame-inner surface. A right surface of the right side frame 100D is referred to as a right-frame-side surface, and a left surface of the right side frame 100D is referred to as a right-frame-inner surface. A front end of the right side frame 100D is referred to as a right-frame-front end, and a rear end of the right side frame 100D is referred to as a right-frame-rear end.

The left side frame 100C and the right side frame 100D rotatably support the driving roller 45, the tension roller 46, the backup roller 48, the driven roller 49, 50 and 51, and the primary transfer roller 54, 55, 56, 57 and 58. A hole is provided at a center of the unit frame 100. That is, the hole is surrounded by the front frame 100A, the rear frame 100B, the left side frame 100C and the right side frame 100D. In the hole of the unit frame 100, the transfer belt 53 having an endless shape is stretched around the driving roller 45, the tension roller 46, the backup roller 48 and the driven roller 49, 50 and 51. A flat upper part of the surface of the transfer belt 53 is exposed via a center opening on an upper surface of the unit frame 100. A convex-shaped lower part of the transfer belt 53 protrudes via a center opening on a lower surface of the unit frame 100.

A coupling 101 (hereinafter referred to as a roller driving coupling 101) is provided on a right end portion of the driving roller 45. The roller driving coupling 101 is configured to receive a driving force from the above described unit driving motor (not shown) provided in the printer casing 2. An end portion of the roller driving coupling 101 protrudes in the right direction from the rear end portion of the right side frame 100D (i.e., protrudes in the right direction from the right-frame-side surface). Connection terminals (not shown) are provided on the right-frame-side surface. The connection terminals are electrically connected with primary transfer rollers 54, 55, 56, 57 and 58. In a state where the transfer unit 20 is mounted in the printer casing 2, the roller driving coupling 101 is connected to a coupling linked with an output shaft of the unit driving motor in the printer casing 2. Further, in a state where the transfer unit 20 is mounted in the printer casing 2, the primary transfer rollers 54, 55, 56, and 58 are electrically connected to the above described voltage sources via the connection terminals. Therefore, in the image forming processing, the driving roller 45 and the transfer belt 53 are driven by the unit driving motor to rotate in the second direction d2.

In this state, the primary transfer rollers 54, 55, 56, 57 and 58 are applied with predetermined voltages (i.e., transfer voltages) by the voltage sources. With the transfer voltages, the toner images are transferred from the primary transfer rollers 54, 55, 56, 57 and 58 of the first through fifth image forming units 15, 16, 17, 18 and 19 to the surface of the transfer belt 53. The toner-ejection-conveying path 92 (elongated in the printer left-right direction) is formed in the rear frame 100B. The cleaning blade 90 and the toner conveying body 90 are disposed in the rear frame 100B.

Figure 3:
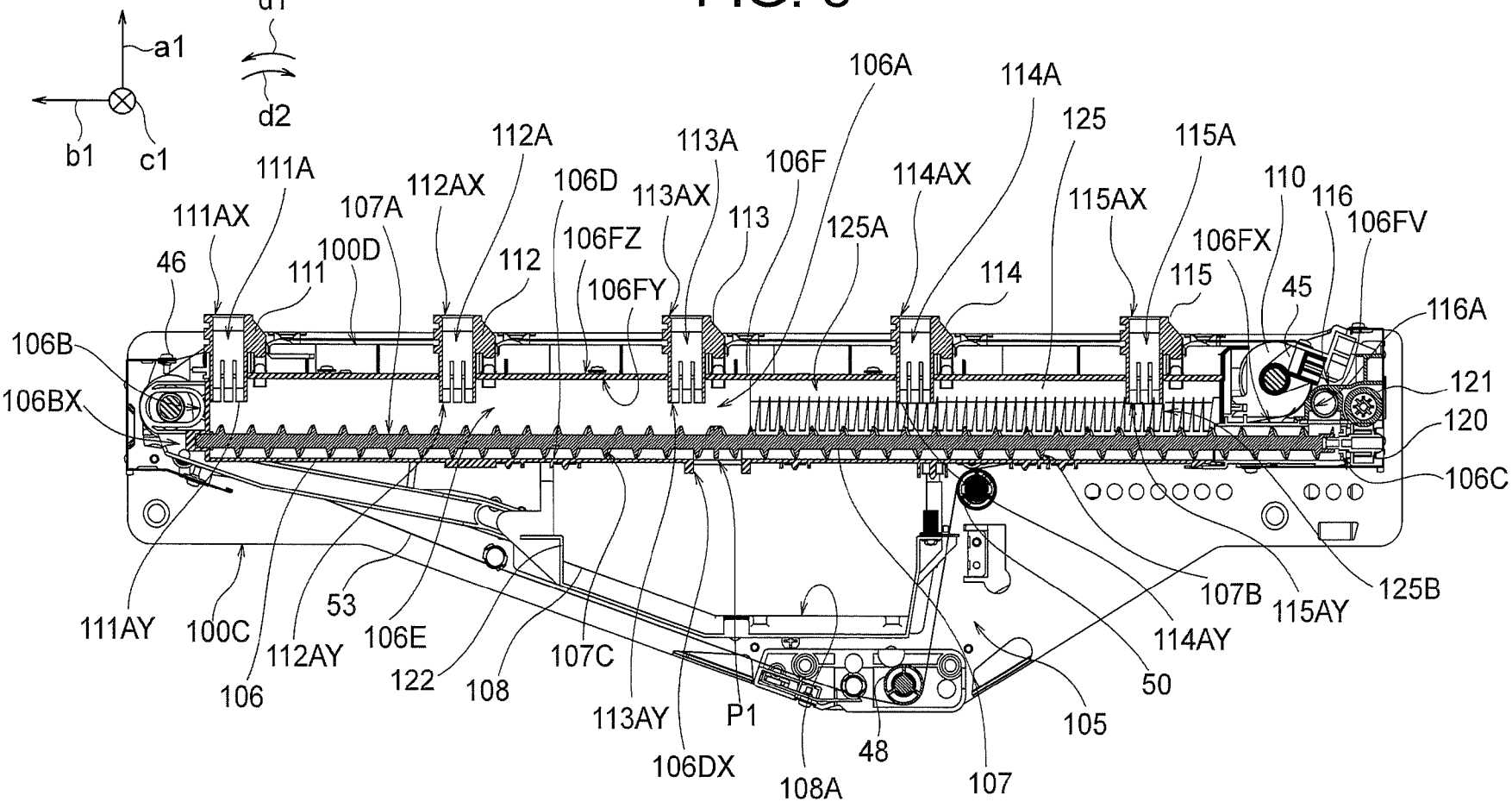
FIG. 3 is a sectional view showing a configuration of a toner conveying/recovery section according to the first embodiment.

FIG. 3 is a sectional view showing a configuration of the toner conveying/recovery section 105 of the first embodiment. As shown in FIGS. 2 and 3, in the transfer unit 20, the toner conveying/recovery section 105 is provided in the right side frame 100D. The toner conveying/recovery section 105 (i.e., a developer conveying device) includes a conveying-path-forming portion 106 having a substantially box shape elongated in the printer front-rear direction. The conveying-path-forming portion 106 forms a toner conveying path 106A (hereinafter referred to as a toner-recovery-conveying path 106A) for conveying the waste toner for recovery. The toner conveying/recovery section 105 includes a toner conveying body 107 (i.e., a developer conveying body) for conveying the waste toner in the toner conveying path 106A, and a toner recovery cassette 108 elongated in the printer left-right direction for recovering the waste toner having been conveyed through the toner conveying path 106A.

The conveying-path-forming portion 106 includes a front end surface 106B (hereinafter referred to as a forming-portion-front-end surface 106B) and a rear end surface 106C (hereinafter referred to as a forming-portion-rear-end surface 106C). A length from the front end surface 106B to the rear end surface 106C in the printer front-rear direction is set to a predetermined length slightly shorter than a length of the right side frame 100D in the printer front-rear direction. The conveying-path-forming portion 106 has a bottom surface 106D having a semicircular cross-sectional shape of a predetermined diameter (hereinafter referred to as a forming-portion-bottom diameter). A left inner surface 106E and a right inner surface (not shown) are formed continuously from the bottom surface 106D. An interval between the left inner surface 106E and the right inner surface (i.e., a length in the printer left-right direction) is the same as the forming-portion-bottom diameter. The conveying-path-forming portion 106 includes a concave portion 106FX provided in the vicinity of a rear end of a top plate 106F having a substantially strip shape. A height of an inner space of the conveying-path-forming portion 106 (i.e., a height from a deepest position on the bottom surface 106D to a lower surface 106FY of the top plate 106F) is substantially the same as the forming-portion-bottom diameter at the convex portion 106FX, but is larger than the forming-portion-bottom diameter at other portions.

The conveying-path-forming portion 106 forms the toner-recovery-conveying path 106A in the form of a U-shaped groove elongated in the printer front-rear direction. A longitudinal direction of the toner-recovery-conveying path 106A (parallel to the printer front-rear direction) is also referred to as a conveying-path-longitudinal direction. By provision of the convex portion 106FX on the top plate 106F, the conveying-path-forming portion 106 does not to interfere with a bearing 110 rotatably supporting the driving roller 45. The conveying-path-forming portion 106 is integrally formed. Further, the conveying-path-forming portion 106 is oriented in such an orientation that the forming-portion-front-end surface 106B is located in the vicinity of the upper end of the right side frame 100D (i.e., the right-frame-front end), the forming-portion-rear-end surface 106C is located in the vicinity of the right-frame-rear end, and the bottom surface 106D is located at a lower side.

Each of the first through fifth image forming units 15, 16, 17, 18 and 19 includes a toner ejection opening (not shown) provided on a right end portion of the toner-ejection-conveying path. Intake-tube-insertion holes are formed at five positions corresponding to the toner ejection openings of the first through fifth image forming units 15, 16, 17, 18 and 19 (i.e., five positions equally distanced in the conveying-path-longitudinal direction) between a front end of an upper surface FZ of the top plate 106F (referred to as a top plate upper surface 106FZ) and the convex portion 106FX. First, second, third, fourth and fifth toner intake tubes 111, 112, 113, 114 and 115 are inserted into the intake-tube-insertion holes from above. The first through fifth toner intake tubes 111, 112, 113, 114 and 115 have toner receiving openings 111AX, 112AX, 113AX, 114AX and 115AX at upper ends thereof. The toner receiving openings 111AX, 112AX, 113AX, 114AX and 115AX protrude upward from the right side frame 100D. The first through fifth toner intake tubes 111, 112, 113, 114 and 115 have toner intake openings 111AY, 112AY, 113AY, 114AY and 115AY at lower ends thereof. The intake openings 111AY, 112AY, 113AY, 114AY and 115AY are inserted into the toner-recovery-conveying path 106A.

In a state where the transfer unit 20 is mounted in the printer casing 2, the toner receiving openings 111AX, 112AX, 113AX, 114AX and 115AX of the first through fifth toner intake tubes 111, 112, 113, 114 and 115 engage the toner ejection openings of the toner-ejection-conveying paths of the first through fifth image forming units 15, 16, 17, 18 and 19. That is, in a state where the transfer unit 20 is mounted in the printer casing 2, the toner-recovery-conveying path 106A is connected to the toner-ejection-conveying paths of the first through fifth image forming units 15, 16, 17, 18 and 19 via the toner receiving openings 111AX, 112AX, 113AX, 114AX and 115AX of the first through fifth toner intake tubes 111, 112, 113, 114 and 115. With such a configuration, the waste toners conveyed through the toner-ejection-conveying paths of the first through fifth image forming units 15, 16, 17, 18 and 19 fall through the toner ejection openings, fall through toner intake paths 111A, 112A, 113A, 114A and 115A of the first through fifth toner intake tubes 111, 112, 113, 114 and 115, and falls on the bottom surface 106D of the toner-recovery-conveying path 106A. In other words, the toner-recovery-conveying path 106A receives the waste toners of black, cyan, magenta, yellow and clear from the toner-ejection-conveying paths of the first through fifth image forming units 15, 16, 17, 18 and 19 via the toner intake paths 111A, 112A, 113A, 114A and 115A.

A toner intake tube insertion hole is formed on an upper rear corner portion (i.e., a convex portion 106FV on a rear side of the concave portion 106FX) of a left side surface of the conveying-path-forming portion 106 facing a right end portion of the toner-ejection-conveying path 92. An end portion of a toner intake tube 116 is inserted into the toner intake tube insertion hole. A root portion of the toner intake tube 116 is joined to the right end portion of the toner-ejection-conveying path 92 in the rear frame 100B. That is, the toner-recovery-conveying path 106A is connected to the toner-ejection-conveying path 92 in the rear frame 100B via a toner intake path 116A of the toner intake tube 116. The mixed waste toner (including the waste toners of five colors) having been conveyed through the toner-ejection-conveying path 92 in the rear frame 100B passes through the toner intake path 116A of the intake tube 116, and is ejected via the toner intake opening at an end of the toner intake path 116A. The ejected waste toner is received by the bottom surface 106D of the toner-recovery-conveying path 106A. That is, the toner-recovery-conveying path 106A receives the mixed waste toners of black, cyan, magenta, yellow and clear from the toner-ejection-conveying path 92 in the rear frame 100B via the toner intake path 116A.

Figure 4:
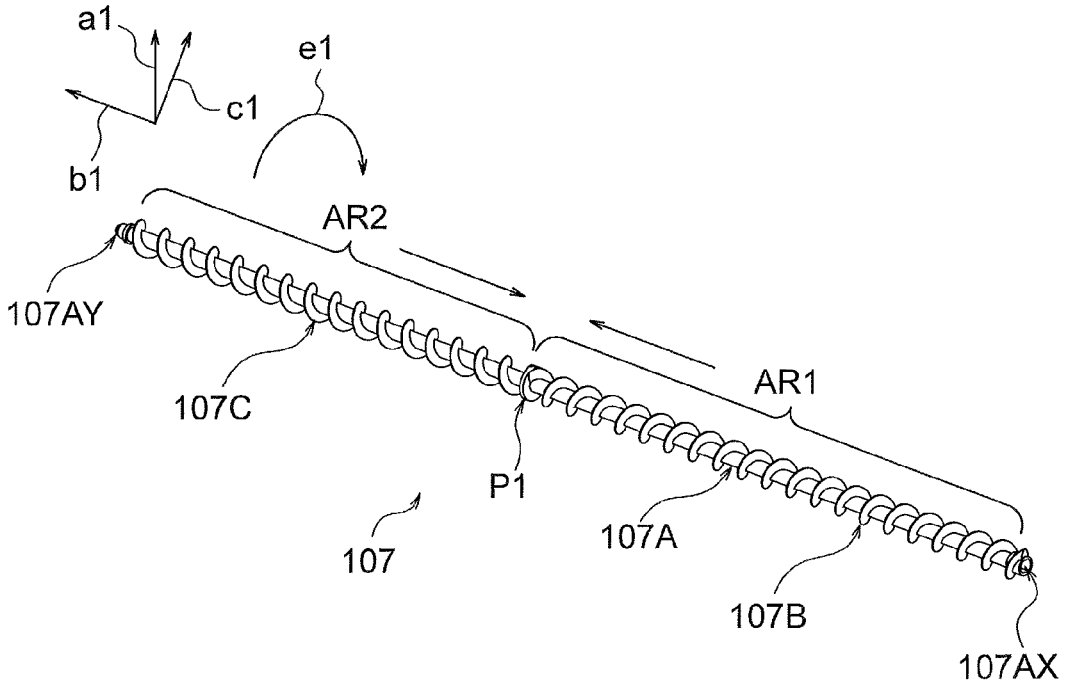
FIG. 4 is a perspective view showing a structure of a toner conveying body according to the first embodiment.

FIG. 4 is a perspective view showing a structure of a toner conveying body 107 of the first embodiment. The toner conveying body 107 is integrally formed of predetermined resin material. The toner conveying body 107 has a shaft portion 107A. The shaft portion 107A has a cylindrical shape, and is slightly longer than a length (i.e., a length in the conveying-path-longitudinal direction) of the toner-recovery-conveying path 106A. Hereinafter, the longitudinal direction of the shaft portion 107A of the toner conveying body 107 is referred to as a conveying-body-shaft-portion-longitudinal direction. The toner conveying body 107 has a gear mounting hole 107AX provided on an end (i.e., a first end described below) of the shaft portion 107A. Further, the toner conveying body 107 includes a first blade portion 107B and a second blade portion 107C on both end sides of the shaft portion 107A. The first blade portion 107B (referred to as a first spiral blade portion 107B) and the second blade portion 107C (referred to as a second spiral blade portion 107C) have oppositely wound (coiled) spiral shapes.

That is, the toner conveying body 107 includes a first blade-portion-forming region AR1 ranging between a predetermined border position P1 at a center portion on a surface of the shaft portion 107A and one end (i.e., the first end) of the shaft portion 107A. In the first blade-portion-forming region AR1, the first spiral blade portion 107B is wound from the first end to the border position P1. The first spiral blade portion 107B is wound counterclockwise as seen from the first end of the shaft portion 107A at a predetermined winding angle. The toner conveying body 107 further includes a second blade-portion-forming region AR2 ranging between the border position P1 and the other end (i.e., a second end) of the shaft portion 107A. In the second blade-portion-forming region AR2, the second spiral blade portion 107C is wound from the second end to the border position P1. The second spiral blade portion 107C is wound clockwise as seen from the first end of the shaft portion 107A at a predetermined winding angle. The winding angles of the first spiral blade portion 107B and the second spiral blade portion 107C are angles of the first spiral blade portion 107B and the second spiral blade portion 107C with respect to a direction perpendicular to the conveying-body-shaft-portion-longitudinal direction of the shaft portion 107A. The second spiral blade portion 107C is not formed on a portion 107AY of the shaft portion 107A on the second end side. Hereinafter, this portion 107AY is referred to as a non-blade-forming end portion 107AY. When the toner conveying body 107 rotates clockwise (as shown by an arrow e1) as seen from the first end of the shaft portion 107A, the first spiral blade portion 107B conveys the waste toner from the first end toward the border position P1 in the first blade-portion-forming region AR1, and the second spiral blade portion 107C conveys the waste toner from the second end toward the border position P1 in the blade-portion-forming region AR2. Hereinafter, a rotating direction of the conveying body 107 (when the conveying body 107 rotates clockwise as seen from the first end of the shaft portion 107A) for conveying the waste toner is referred to as a toner-conveying-rotating direction as a developer-conveying-rotating direction.

Figure 5:
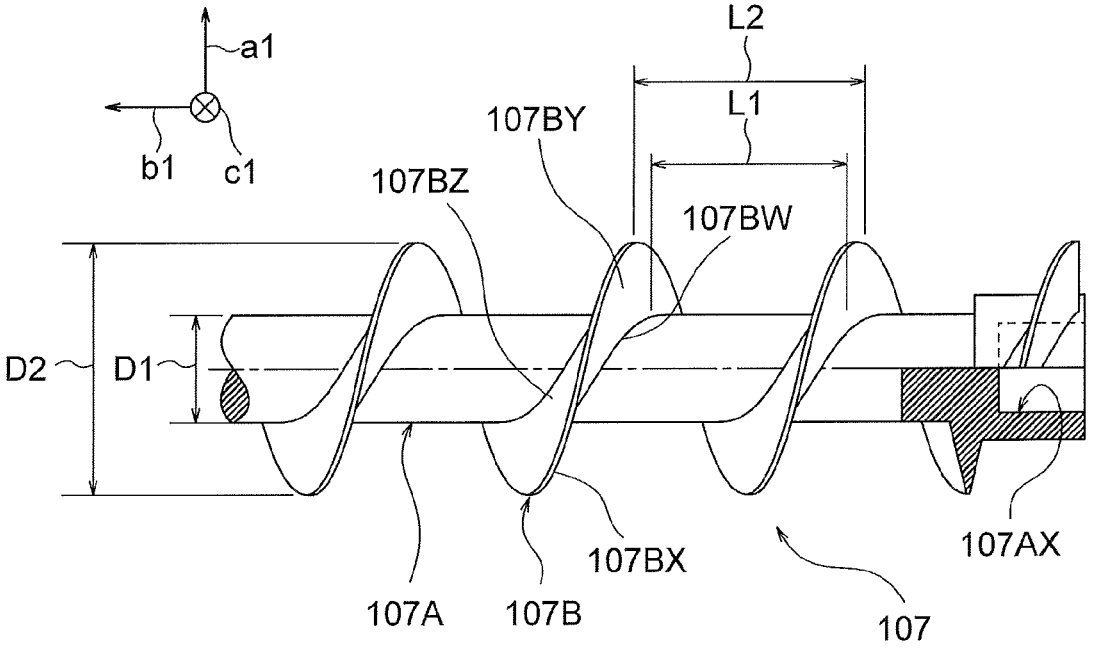
FIG. 5 is a partially-cutaway side view showing a structure of a first spiral blade portion of the toner conveying body according to the first embodiment.

FIG. 5 is a partially-cutaway side view showing a structure of the first spiral blade portion 107B of the toner conveying body 107 of the first embodiment. An outer diameter D1 of the shaft portion 107A of the toner conveying body 107 is set to be, for example, a predetermined outer diameter (for example, approximately 6 mm) smaller than the forming-portion-bottom diameter. An outer diameter D2 of the first spiral blade portion 107B of the toner conveying body 107 is set to be, for example, a predetermined outer diameter (for example, approximately 14 mm) which is substantially the same as the forming-portion-bottom diameter. The first spiral blade portion 107B have a chevron shape such that a thickness of the first spiral blade portion 107B gradually decreases from a root portion 107BW toward a tip portion 107BX. Hereinafter, an inclined surface of the first spiral blade portion 107B facing the first end side in the conveying-body-shaft-portion-longitudinal direction is referred to as a first inclined surface 107BY. An inclined surface of the first spiral blade portion 107B facing the second end side in the conveying-body-shaft-portion-longitudinal direction is referred to as a second inclined surface 107BZ. An interval L1 between the root portions 107BW of the first spiral blade portion 107B is set to a predetermined interval (for example, approximately 11 mm). An interval L2 between the tip portions 107BX of the first spiral blade portion 107B is set to a larger predetermined interval (for example, approximately 14 mm).

The second spiral blade portion 107C has the same structure as the first spiral blade portion 107B except for its winding direction. In the conveying-path-forming portion 106 (FIG. 3), a shaft insertion portion 106BX protrudes from the forming-portion-front-end surface 106B. The shaft insertion portion 106BX is located at a height approximately equal to a half of the forming-portion-bottom diameter from the lower end of the forming-portion-front-end surface 106B. The shaft insertion portion 106BX has a cylindrical shape whose bottom is closed. A concave portion of the shaft insertion portion 160BX leads to the toner-recovery-conveying path 106A. A bearing mounting hole is formed on the forming-portion-rear-end surface 106C. The bearing mounting hole is located at a height approximately equal to a half of the forming-portion-bottom diameter from the lower end of the forming-portion-rear-end surface 106C. A bearing is mounted to the bearing mounting hole. A gear shaft portion of a screw gear 120 (referred to a conveying-body-side-screw gear) is inserted through the bearing from the forming-portion-rear-end surface 106C. The screw gear 120 is provided for rotating the toner conveying body 107. A tip of the gear shaft portion protrudes into the toner-recovery-conveying path 106A. The toner conveying body 107 is housed in the conveying-path-forming portion 106 in such an orientation that the conveying-body-shaft-portion-longitudinal direction is parallel to the conveying-path-longitudinal direction. The non-blade-forming end portion 107AY of the shaft portion 107A is inserted into the shaft insertion portion 106BX. An end portion of the gear shaft portion is mounted to the gear mounting hole 107AX of the shaft portion 107A. With such a configuration, the toner conveying body 107 is supported via the shaft insertion hole 106B and the bearings so that the toner conveying body 107 is rotatable in the toner-conveying-rotating direction about the shaft portion 107A while lower halves of the first spiral blade portion 107B and the second spiral blade portion 107C contact or closely face the bottom surface 106D of the toner-recovery-conveying path 106A.

The right side frame 100D rotatably supports a not shown coupling (hereinafter referred to as a conveying-body-driving coupling) at the rear side of the roller driving coupling 101 (FIG. 3) in such an orientation that a center axis of the coupling is parallel to the printer left-right direction. The conveying-body-driving coupling is provided for transmitting a driving force from the unit driving motor in the printer casing 2 to the toner conveying body 107. A tip of the conveying-body-driving coupling protrudes in the right direction from the right-frame-side surface. A screw gear 121 (hereinafter referred to as a coupling side-screw gear) provided on a root portion of the conveying-body-driving coupling is located in the right side frame 100D, and meshes with the conveying-body-side-screw gear 120. In a state where the transfer unit 20 is mounted in the printer casing 2, the conveying-body-driving coupling is connected to a coupling linked with the output shaft of the unit driving motor in the printer casing 2. Therefore, in the image forming processing, the coupling-side-screw gear 121 and the conveying-body-driving coupling are driven by the unit driving motor to rotate in, for example, the second rotating direction d2. The rotation of the coupling-side-screw gear 121 is transmitted to the conveying-body-side-screw gear 120, and the conveying-body-side-screw gear 120 and the toner conveying body 107 rotate in the toner-conveying-rotating direction (as shown by the arrow e1 in FIG. 4) in the toner-recovery-conveying path 106A.

As described above, the first spiral blade portion 107B and the second spiral blade portion 107C are wounded in opposite directions. Therefore, in the toner-recovery-conveying path 106A, a conveying direction of the waste toner in a region where the first spiral blade portion 107B of the toner conveying body 107 is provided is opposite to a conveying direction of the waste toner in a region where the second spiral blade portion 107C is provided. That is, when the toner conveying body 107 rotates in the toner-conveying-rotating direction e1, the waste toner is conveyed from the rear side toward the front side (i.e., toward the printer front side) in the region where the first spiral blade portion 107B is provided.

When the toner conveying body 107 rotates in the toner-conveying-rotating direction, the waste toner is conveyed from the front side toward the rear side (i.e., toward the printer rear side) in the region where the second spiral blade portion 107C is provided. Hereinafter, the region where the first spiral blade portion 107B of the toner conveying body 107 is provided is referred to as a first conveying region. The conveying direction of the waste toner in the first conveying region (i.e., from the rear side toward the front side) is referred to as a first conveying direction. The region where the second spiral blade portion 107C of the toner conveying body 107 is provided is referred to as a second conveying region. The conveying direction of the waste toner in the second conveying region (i.e., from the front side toward the rear side) is referred to as a second conveying direction. The toner intake paths 114A and 115A (corresponding to the fourth and fifth image forming units 18 and 19) and the toner intake path 116A (corresponding to the toner-ejection-conveying path 92 in the rear frame 100B) are located in the first conveying region in the toner-recovery-conveying path 106A.

The toner intake paths 111A, 112A and 113A (corresponding to the first, second and third image forming units 15, 16 and 17) are located in the second conveying region in the toner-recovery-conveying path 106A. Therefore, when the toner conveying body 107 rotates in the toner-conveying-rotating direction as shown by the arrow e1 in the toner-recovery-conveying path 106A, the toner conveying/recovery section 105 conveys the waste toner (including the mixed waste toner of five colors and the waste toners of yellow and clear) in the first conveying direction from a rear end portion to a center portion on the bottom surface 106D using the first spiral blade portion 107B contacting or closely facing the bottom surface 106D.

When the toner conveying body 107 rotates in the toner-conveying-rotating direction as shown by the arrow e1 in the toner-recovery-conveying path 106A, the toner conveying/recovery section 105 conveys the waste toner (including the waste toners of black, cyan and magenta) in the second conveying direction from a front end portion to the center portion on the bottom surface 106D using the second spiral blade portion 107C contacting or closely facing the bottom surface 106D. In this regard, when the waste toner is conveyed by the toner conveying body 107 in the first conveying region and the second conveying region in this way, the waste toner tends to be accumulated at a portion (on a center portion of the bottom surface 106D) facing the border position 21 of the toner conveying body 107 (i.e., a border between the first conveying region and the second conveying region). For this reason, a toner ejection opening 106DX having a predetermined size is provided at a portion on the center portion of the bottom surface 106D so as to face the border position P1 of the toner conveying body 107. The toner ejection opening 106DX is provided for ejecting the waste toner from the toner-recovery-conveying path 106A to the toner recovery cassette 108.

The toner recovery cassette 108 has a predetermined length in a longitudinal direction thereof (i.e., the printer left-right direction) which is slightly shorter than a width of the transfer unit 20 in the printer left-right direction (i.e., a length from the left-frame-side surface to the right-frame-side surface). The toner recovery cassette 108 has a recovery container 108A having a substantially box shape at a right end portion thereof. The recovery container 108A is configured to recover and store the waste toner. The toner recovery cassette 108 has a grip portion (not shown) at a left end portion thereof. The recovery container 108A has a predetermined width (i.e., a length in the printer front-rear direction) which is longer than a length (i.e., a length in the printer front-rear direction) of the toner ejection opening 106DX of the conveying-path-forming portion 106. The recovery container 108A has a predetermined depth (i.e., a length in the printer left-right direction) which is longer than a width (i.e., a length in the printer left-right direction) of the conveying-path-forming portion 106. The toner recovery cassette 108 has a toner intake opening formed on the upper end of the recovery container 108A. The toner intake opening is larger than the toner ejection opening 106DX of the conveying-path-forming portion 106. In the right side frame 100D, a container supporting portion 122 for supporting the recovery container 108A of the toner recovery cassette 108 is provided on the right-frame-inner surface. The container supporting portion 122 is located directly below the center portion of the conveying-path-forming portion 106. In the left side frame 100C, a cassette insertion hole (not shown) is formed at a position facing the container supporting portion 122 of the right side frame 100D.

With such a configuration, the toner recovery cassette 108 is detachably mounted to the transfer unit 20. To be more specific, the toner recovery cassette 108 is inserted into the cassette insertion hole from the left-frame-side surface side in a state where the door of the printer casing 2 is opened. Further, the toner recovery cassette 108 is pulled out from the cassette insertion hole toward the left-frame-side surface side. In a state where the toner recovery cassette 108 is mounted to the transfer unit 20, the recovery container 108A engages the container supporting portion 122 of the right side frame 100D, so that the toner intake opening of the recovery container 108A is located directly below the toner ejection opening 106A of the conveying-path-forming portion 106. In this state, the waste toner having been conveyed by the toner conveying body 107 in the toner-recovery-conveying path 106A is ejected via the toner ejection opening 106DX, and falls in the recovery container 108A. In this way, the toner recovery cassette 108 recovers the waste toner, and stores the waste toner.

In the image forming processing, the waste toner having been conveyed by the toner-ejection-conveying paths of the first through fifth image forming units 15, 16, 17, 18 and 19 and the toner-ejection-conveying path 92 in the rear frame 100B is supplied into the toner-recovery-conveying path 106A. The waste toner is further conveyed by the toner conveying body 107 in the toner-recovery-conveying path 106A, is ejected via the toner ejection opening 106DX, and is recovered by the recovery container 108A of the toner recovery cassette 108. When an amount of the waste toner stored in the recovery container 108A of the toner recovery cassette 108 exceeds a predetermined amount, the toner recovery cassette 108 is pulled out from the transfer unit 20, and is replaced with a new toner recovery cassette 108 having an empty recovery container 108A.

In the image forming processing, the black (K), cyan (C), magenta (M) and yellow (Y) toners are used to form toner images of black, cyan, magenta and yellow. In contrast, the clear (CL) toner is used to form a solid image (i.e., a coating) entirely covering a surface of the toner images of black, cyan, magenta and yellow, or used to form a solid image entirely covering the surface of the recording medium 5. Therefore, an amount of the clear toner used for each recording medium 5 is larger than any of the amounts of the black, cyan, magenta and yellow toners used for each recording medium 5. Therefore, among the waste toners having been removed from the surfaces of the photosensitive drums 30, 31, 32, 33 and 34 and the surface of the transfer belt 53 and supplied into the toner-recovery-conveying path 106A of the toner conveying/recovery section 105, the amount of the clear waste toner is the larger than any of the waste toners of other colors.

The clear waste toner removed from the surface of the transfer belt 53 by the cleaning blade 90 is supplied into the first conveying region of the toner-recovery-conveying path 106A at a most upstream position in the first conveying direction, as well as the black, cyan, magenta and yellow waste toners removed from the surface of the transfer belt 53 by the cleaning blade 90. Further, the clear waste toner removed from the surface of the photosensitive drum 34 of the fifth image forming unit 19 by the cleaning blade 84 is supplied into the first conveying region of the toner-recovery-conveying path 106A at a slightly downstream position with respect to the most upstream position in the first conveying direction. Therefore, the amount of the waste toner conveyed in the first conveying direction by the first spiral blade portion 107B in the first conveying region of the toner-recovery-conveying path 106A is larger than the amount of the waste toner conveyed in the second conveying direction by the second spiral blade portion 107C in the second conveying region. Further, the amount of the waste toner conveyed in an upstream part of the first conveying region in the first conveying direction is larger than the amount of the waste toner conveyed in a downstream part of the first conveying region in the first conveying direction. In the toner-recovery-conveying path 106A, as the amount of the waste toner conveyed by the toner conveying body 107 becomes larger, the waste toner becomes more likely to adhere to the surface of the shaft portion 107A of the toner conveying body 107. That is, the waste toner (conveyed by the first spiral blade portion 107B of the toner conveying body 107) may be agglomerated between the root portions 107BW and the tip portions 107BX of the first spiral blade portion 107B at the downstream part in the first conveying direction. In such a case, the waste toner may not be conveyed even when the toner conveying body 107 rotates in the toner-conveying-rotating direction as shown by the arrow e1. For this reason, the toner conveying/recovery section 105 includes a toner removing portion 125 as a developer removing portion that removes the waste toner from the surface of the shaft portion 107A of the toner conveying body 107 at the first blade-portion-forming region AR1.

Figure 6A:
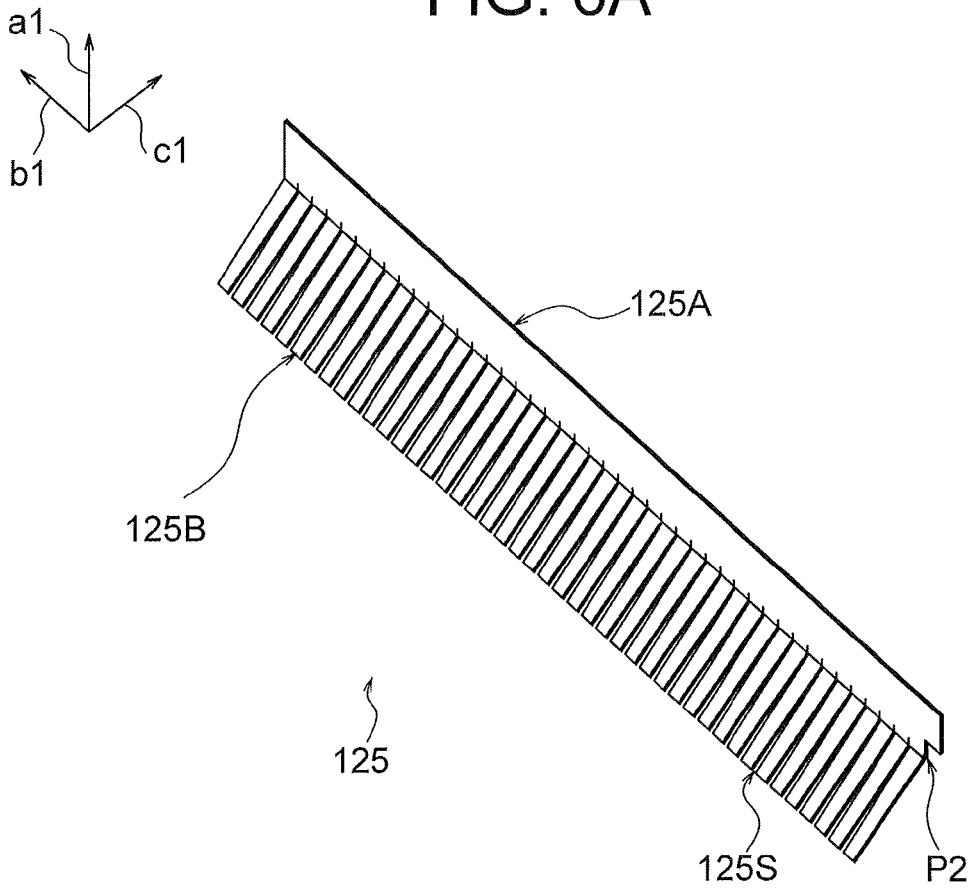
FIG. 6A is a perspective view showing a structure of a toner removing portion according to the first embodiment.
Figure 6B:
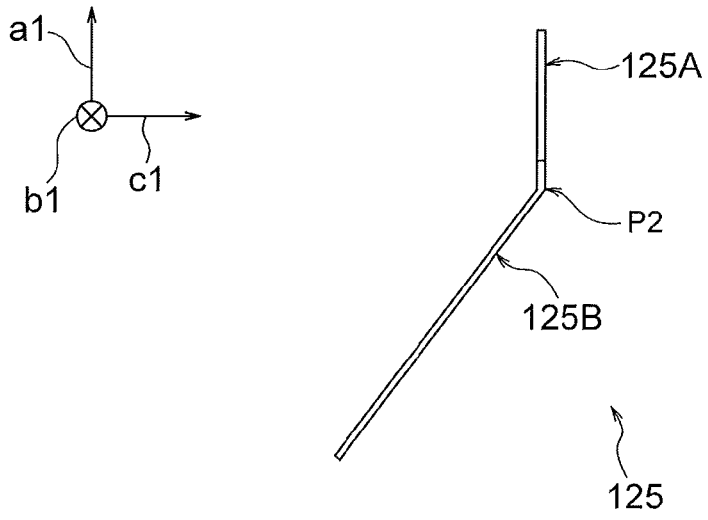
FIG. 6B is a side view showing the structure of the toner removing portion according to the first embodiment.

FIGS. 6A and 6Ba are a perspective view and a side view showing a structure of the toner removing portion 125 of the first embodiment. The toner removing portion 125 is formed of resin material having a resiliency such as polyester. The toner removing portion 125 is in the form of a sheet having a substantially rectangular shape. Hereinafter, a longitudinal direction of the toner removing portion 125 (i.e., a direction along a longer edge of the toner removing portion 125) is referred to as a removing-portion-longitudinal direction. A transverse direction of the toner removing portion 125 (i.e., a direction along a shorter edge of the toner removing portion 125) is referred to as a removing-portion-transverse direction. A length of the toner removing portion 125 in the removing-portion-longitudinal direction is set to a predetermined length substantially the same as a length from a front surface of the concave portion 106FX to the vicinity of the toner ejection opening 106DX of the conveying-path-forming portion 106. A length of the toner removing portion 125 in the removing-portion-transverse direction is set to a predetermined length longer than the forming-portion-bottom diameter. The toner removing portion 125 includes a removing-portion-main body 125A. The removing-portion-main body 125A has a substantially strip shape elongated in the removing-portion-longitudinal direction. The removing-portion-main body 125A includes a plurality of toner removing fins 125B as developer removing fins elongated in the removing-portion-transverse direction. The toner removing fins 125B have plate shapes, and are provided on one longer edge side of the removing-portion-main body 125A. The toner removing fins 125B are arranged in the removing-portion-longitudinal direction at constant intervals via V-shaped slits 125S having relatively acute angles. That is, the toner removing fins 125B have the same trapezoid shapes such that ends 125BX (referred to as fin ends) of the toner removing fins 125B are narrower than root portions 125BW of the toner removing fins 125B. The fin ends 125BX are parallel to the removing-portion-longitudinal direction. The toner removing fins 125B are bent to a surface side of the removing-portion-main body 125A at a predetermined bending position P2 of the root portions 125BW (i.e., portions on the removing-portion-main body 125A side). A predetermined obtuse angle is formed between the toner removing fins 125B and a surface of the removing-portion-main body 125A.

Figure 7:
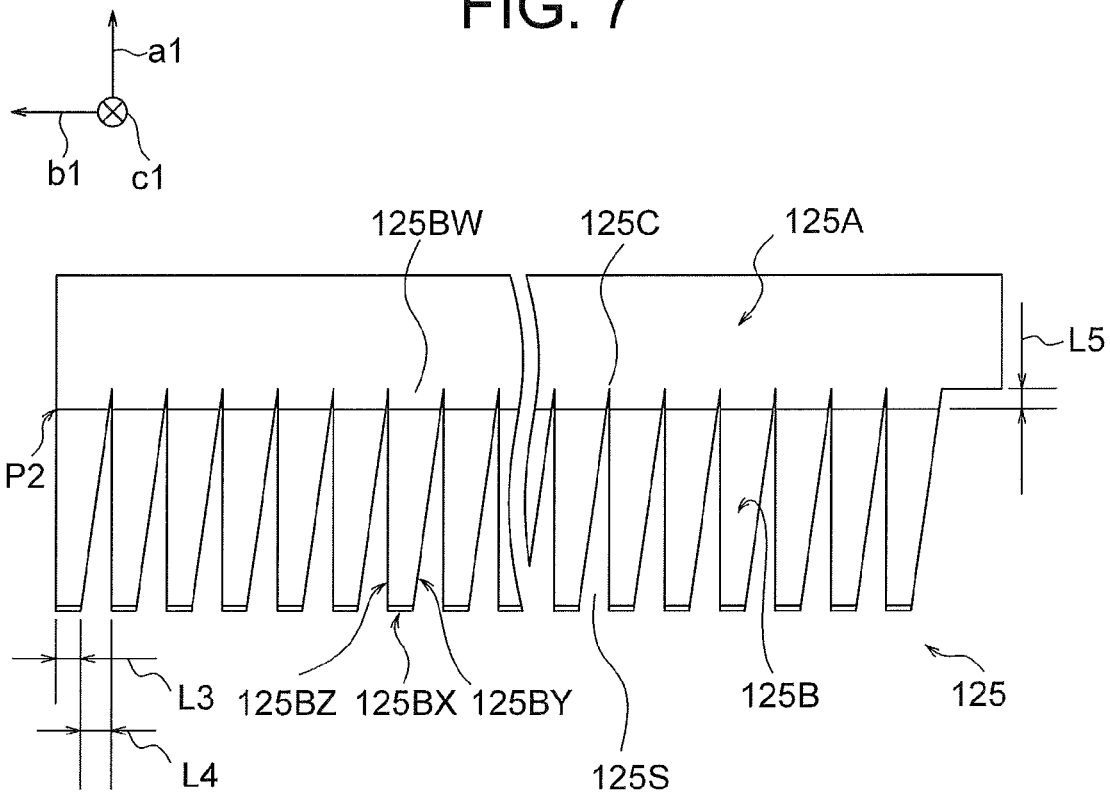
FIG. 7 is a front view showing a structure of the toner removing portion with toner removing pins according to the first embodiment.

FIG. 7 shows a shape of the toner removing portion 125 in a state where the toner removing fins 125B are not yet bent at the root portions 125BW. As shown in FIG. 7, in the state where the toner removing fins 125B are not yet bent at the root portions 125BW, an edge portion 125BY of each toner removing fin 125B closer to an end (i.e., a first end) of the removing-portion-main body 125A in the removing-portion-longitudinal direction (hereinafter referred to as a first edge portion 125BY) is inclined at an acute angle toward the other end (i.e., a second end) of the removing-portion-main body 125A. Further, in the state where the toner removing fins 125B are not yet bent at the root portions 125BW, another edge portion 125BZ of each toner removing fin 125B closer to the second end of the removing-portion-main body 125A in the removing-portion-longitudinal direction (hereinafter referred to as a second edge portion 125BZ) is approximately parallel to the removing-portion-transverse direction. An inclination angle of the first edge portion 125BY of each toner removing fins 125B with respect to the removing-portion-transverse direction is set to a predetermined angle which is near the winding angle of the first spiral blade portion 107B as close as possible.

A width L3 of the fin end 125BX of each toner removing fin 125B is set to a predetermined width (for example, approximately 2 mm) which is sufficiently shorter than the interval L1 (FIG. 5) between the root portions 107BW of the first spiral blade portion 107B of the toner conveying body 107. An interval L4 between the fin ends 125BX of the adjacent toner removing fins 125B is set to a predetermined interval (for example, approximately 2.5 mm) which is sufficiently shorter than the interval L1 between the root portions 107BW of the first spiral blade portion 107B of the toner conveying body 107. The toner removing portion 125 is configured so that at least two toner removing fins 125B contact the surface of the shaft portion 107A of the toner conveying body 107 between the adjacent root portions 107BW of the first spiral blade portion 107B as described later.

The toner removing portion 125 has a resiliency, and therefore the toner removing fins 125B can be respectively displaced toward the surface side or a back side of the removing-portion-main body 125A. Each toner removing fin 125B is narrow at an end (i.e., the fin end 125Bx), but is wide at the root portion 125BW, and therefore the toner removing fin 125B has restorability. Therefore, even when the toner removing fins 125B are respectively displaced, the toner removing fins 125B can easily and certainly return to their original positions. Due to the restorability, the toner removing fins 125B are displaced about the bending position P2. The bending position P2 is set to be a position shifted from terminal ends 125C of the slits 125S (referred to as slit ends 125C) toward the fin ends 125BX by a distance L5 (for example, approximately 2 mm). Therefore, when the toner conveying body 107 rotates in the toner-conveying-rotating direction in such a manner than the toner removing fins 125B contact the first spiral blade portion 107B, the toner removing fins 125B are prevented from floating up by sliding contact with the first spiral blade portion 107B. That is, a time for which the fin ends 125BX of the toner removing fins 125B contact the surface of the shaft portion 107A can be sufficiently lengthened. Further, when the toner removing fins 125B are respectively displaced, the toner removing portion 125 is prevented from being broken off between the root portions 125BW of the toner removing fins 125B (i.e., the slit ends 125C). That is, the toner removing portion 125 is prevented from being damaged. Furthermore, even if burrs are formed at the root portions 125BW of the toner removing fins 125B when forming the slits 125S, the burrs are prevented from interfering each other and from hindering motions of the toner removing fins 125B.

Figure 8:
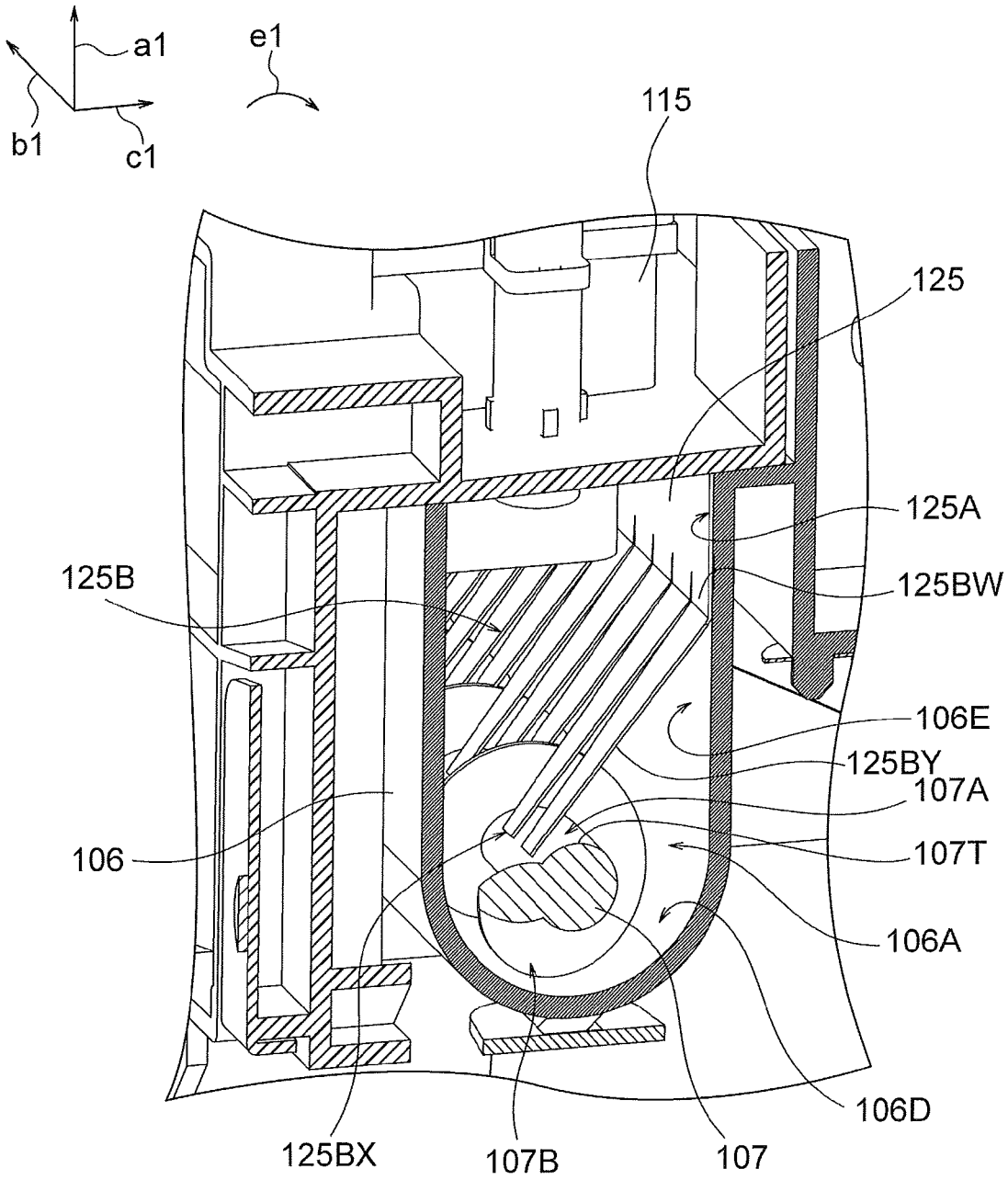
FIG. 8 is a perspective view showing an arrangement of the toner removing portion in a toner-recovery-conveying path according to the first embodiment.

FIG. 8 is a perspective view showing an arrangement of the toner removing portion 125 in the toner-recovery-conveying path 106A. The toner removing portion 125 is provided in the toner-recovery-conveying path 106A so that the removing-portion-longitudinal direction is parallel to the conveying-path-longitudinal direction, and the toner removing fins 125B are inclined so that the fin ends 125BX are directed in an obliquely lower right direction. The back surface of the removing-portion-main body 125A is fixed (bonded) to a part on an upper end portion of the left inner surface 106E of the conveying-path-forming portion 106. The toner removing portion 125 extends from the front vicinity of the concave portion 106FX (FIG. 3) to the vicinity of a position directly above the toner ejection opening 106DX. In the toner-recovery-conveying path 106A, the toner removing fins 125B are provided in at least a region extending from the toner intake opening 115AY (for receiving the clear waste toner) to the vicinity of the toner ejection opening 106DX for ejecting the waste toner to the recovery container 108A. Further, the toner removing fins 125B are inclined so that the fin ends 125BX are located upstream of the root portions 125BW in the toner-conveying-rotating direction and are brought to the vicinity of the toner conveying body 107. That is, as shown in FIG. 8, the fin ends 125BX are pressed against the surface of the shaft portion 107A of the toner conveying body 107 in the first blade-portion-forming region AR1 in such an orientation that the fin ends 125BX are located upstream of the root portions 125BW of the toner removing fins 125B in the toner-conveying-rotating direction. That is, the fin ends 125BX are pressed against the surface of the shaft portion 107A in such an orientation that the fin ends 125BX receive the rotation of the toner conveying body 107. In other words, the fin ends 125BX are pressed against (i.e., contact) the surface of the shaft portion 107A in a counter direction with respect to the toner-conveying-rotating direction. The fin ends 125BX contact a portion of the shaft portion 107A downstream of a top position 107T (i.e., an uppermost position) of the shaft portion 107A in the toner-conveying-rotating direction.

Figure 9:
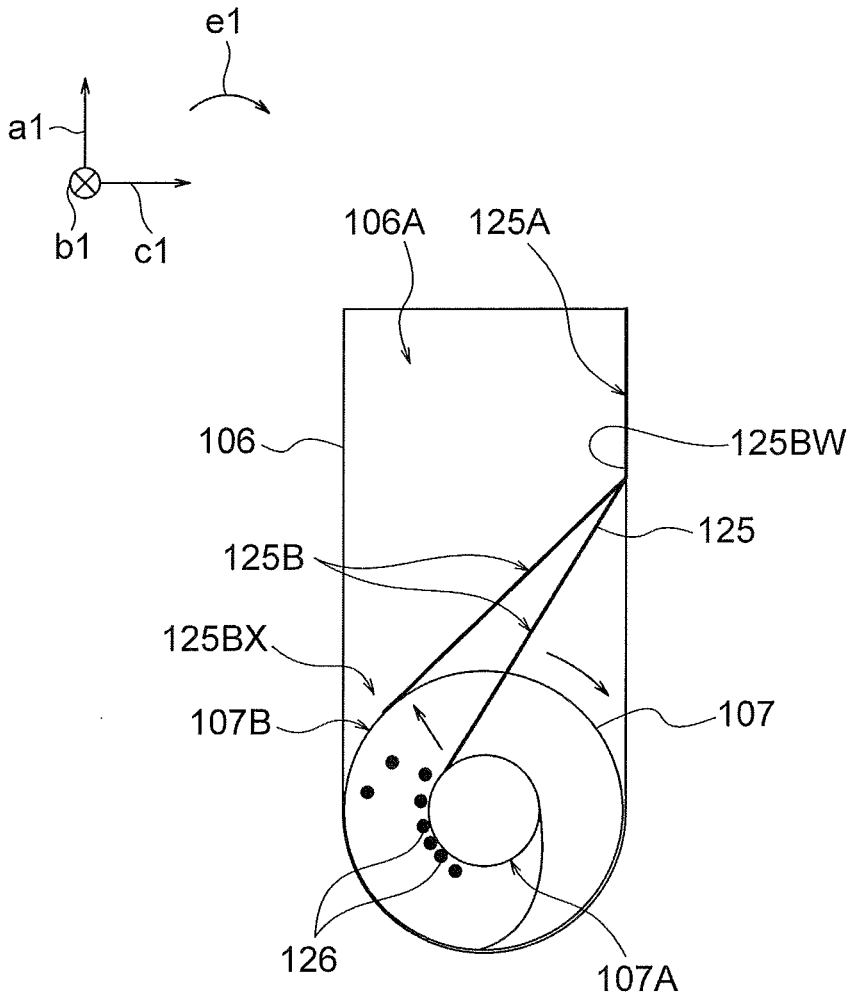
FIG. 9 is a schematic side view for illustrating a manner in which the toner removing portion removes a waste toner from the toner conveying body.

FIG. 9 is a schematic side view for illustrating a manner in which the toner removing portion 125 removes the waste toner from the toner conveying body 107. When the toner conveying body 107 rotates in the toner-recovery-conveying path 106A, the second inclined surface 107BZ (FIG. 5) of the first spiral blade portion 107B is pressed against the first edge portions 125BY (FIG. 7) of the toner removing fins 125B (whose fin ends 125BX are pressed against the surface of the shaft portion 107A). Further, the first edge portions 125BY move upward while sliding along the second inclined surface 107BZ of the first spiral blade portion 107B, and the first spiral blade portion 107B moves to the back surface side of the toner removing fins 125B. Therefore, the toner removing fins 125B are displaced upward by the first spiral blade portion 107B, and return to their original positions as the first spiral blade portion 107B moves to the back surface side of the toner removing fins 125B. That is, the toner removing fins 125B are pressed against the surface of the shaft portion 107A again.

In this way, when the toner conveying body 107 rotates in the toner-conveying-rotating direction, the toner removing fins 125B are displaced upward and downward according to a motion of the first spiral blade portion 107B as if waves are generated and proceed in the first conveying direction. When the toner removing fins 125B are displaced, the second inclined surface 107BZ of the first spiral blade portion 107B may contact the first edge portion 125BY. However, since the first edge portion 125BY is inclined as described above, corners of the fin ends 125BX of the toner removing fins 125B are prevented from being damaged (i.e., flipped or crushed). Further, even in a state where the toner removing fins 125B are displaced according to the rotation of the toner conveying body 107 in the toner-conveying-rotating direction, the fin ends 125BX of at least two toner removing fins 125B are pressed against the surface of the shaft portion 107A between adjacent root portions 107BW of the first spiral blade portion 107B in the counter direction. Therefore, even if the waste toner 126 adheres to the surface of the shaft portion 107A during the rotation of the toner conveying body 107 in the toner-conveying-rotating direction, the fin ends 125BX of the toner removing fins 125B butt against the waste toner 126 and scrape off the waste toner 126.

The waste toner 126 butted by the fin ends 125BX of the toner removing fins 125B may move to the surface side of the toner removing fins 125B. However, when the toner removing fins 125B are displaced by being pushed upward by the first spiral blade portion 107B, the toner removing fins 125B shake off the waste toner 126. The waste toner 126 shaken off by the toner removing fins 125B falls on the bottom surface 106D of the toner-recovery-conveying path 106A. The toner removing fins 125B are disposed above the toner conveying body 107. The V-shaped slits 125S are formed between the adjacent toner removing fins 125B as described above. Further, as shown in FIG. 9, while the toner conveying body 107 rotates in the toner-conveying-rotating direction, the toner removing fins 125B are inclined so that the fin ends 125BX of the toner removing fins 125B are located at obliquely lower right positions with respect to the root portions 125BW even in a state where the toner removing fins 125B are displaced.

Therefore, when the waste toner 126 falls from the toner intake paths 114A and 115A, the waste toner 126 slips on inclined surfaces of the toner removing fins 125B, and falls on the bottom surface 106D of the toner-recovery-conveying path 106A. The toner conveying body 107 conveys the waste toner 126 (supplied to the first conveying region of the toner-recovery-conveying path 106A) on the bottom surface 106D in the first conveying direction using the first spiral blade portion 107B that contacts or closely faces the bottom surface 106D.

Figure 10:
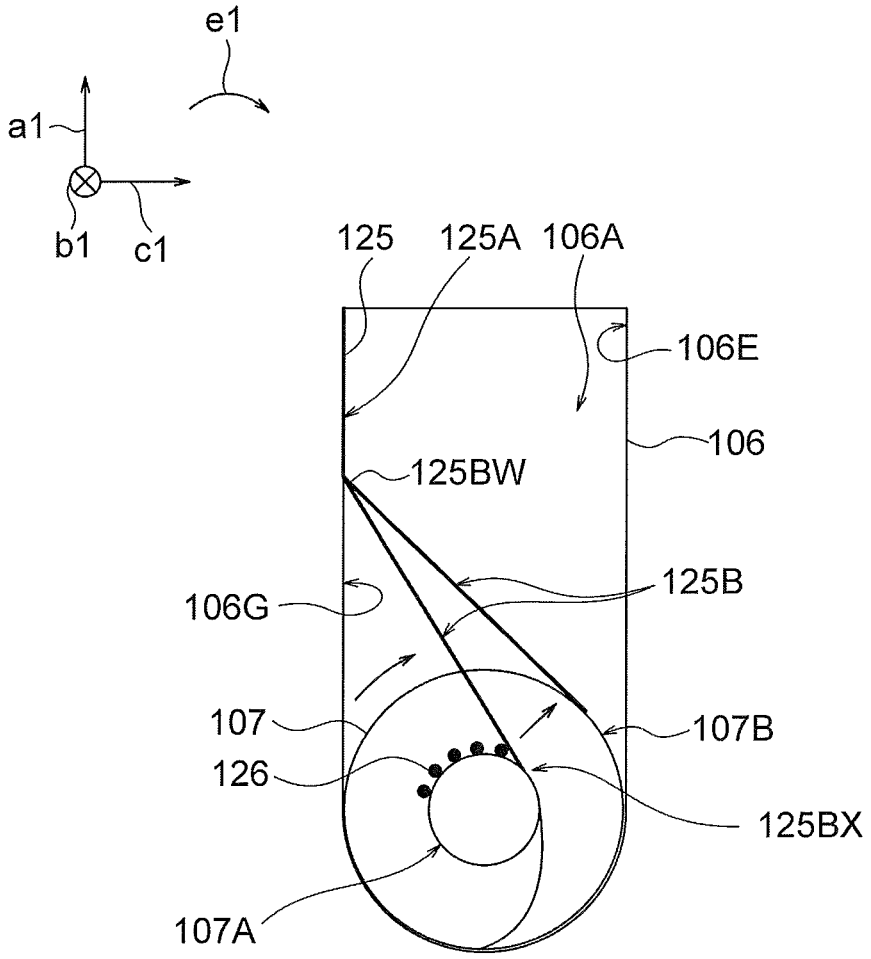
FIG. 10 is a schematic side view for illustrating a manner in which the waste toner is removed from the toner conveying body by the toner removing portion in the case where the toner removing portion is mounted in a different orientation.

FIG. 10 shows an example in which the toner removing portion 125 is mounted to the conveying-path-forming portion 106 in a different orientation. In this example, the back surface of the removing body main body 125A is fixed (bonded) to an upper end portion of the right inner surface 106G of the conveying-path-forming portion 106 in a different orientation from that shown in FIG. 9. In this case, the fin ends 125BX of the toner removing fins 125B are pressed against the surface of the shaft portion 107A of the toner conveying body 107 in such an orientation that the fin ends 125BX are locate downstream of the root portions 125BW of the toner removing fins 125B in the toner-conveying-rotating direction. In other words, the fin ends 125BX are pressed against the surface of the shaft portion 107A in a forward direction with respect to the toner-conveying-rotating direction. When the toner conveying body 107 rotates in the toner-conveying-rotating direction in the toner-recovery-conveying path 106A, the waste toner 126 adhering to the surface of the shaft portion 107A slips under end portions of the toner removing fins 125B. Therefore, the toner removing fins 125B cannot sufficiently remove the waste toner 126 from the surface of the shaft portion 107A of the toner conveying body 107 if the toner removing fins 125B are mounted as shown in FIG. 10.

In contrast, according to this embodiment, the fin ends 125BX of the toner removing fins 125B are pressed against the surface of the shaft portion 107A of the toner conveying body 107 in the counter direction as shown in FIG. 9. Therefore, the toner removing fins 125B can sufficiently remove the waste toner 126 from the surface of the shaft portion 107A of the toner conveying body 107, and can prevent the waste toner 126 from adhering to the surface of the shaft portion 107A of the toner conveying body 107. Accordingly, it becomes possible to prevent the agglomeration of the waste toner 126 between the root portions 107BW or the tip portions 107BX of the first spiral blade portion 107B.

Effects of First Embodiment

As described above, in the color printer 1, the toner conveying body 107 is provided in the toner conveying/recovery section 105 having the toner-recovery-conveying path 106A. The toner conveying body 107 is rotatable in the toner-conveying-rotating direction, and includes the shaft portion 107A and the first spiral blade portion 107B formed on the surface of the shaft portion 107A. The toner removing portion 125 having the toner removing fins 125B is provided so that the fin ends 125BX of the toner removing fins 125B are pressed against the surface of the shaft portion 107A of the toner conveying body 107 in the counter direction with respect to the toner-conveying-rotating direction. Therefore, even if the waste toner 126 adheres to the shaft portion 107A of the toner conveying body 107 while the toner conveying body 107 conveys the waste toner 126 by rotating in the toner-conveying-rotating direction in the toner-recovery-conveying path 106A, the toner removing fins 125B can scrape off the waste toner 126 from the shaft portion 107A by causing the fin ends 125BX to butt against the waste toner 126. That is, the waste toner 126 can be certainly prevented from adhering to the surface of the shaft portion 107A of the toner conveying body 107. As a result, while the toner conveying body 107 conveys the waste toner 126 by rotating in the toner-conveying-rotating direction in the toner-recovery-conveying path 106A, a decrease in the conveying capacity can be prevented.

Further, the width and interval of the fin end 125BX of each toner removing fin 125B are narrower than the interval between the root portions 107BW of the first spiral blade portion 107B of the toner conveying body 107. Therefore, even when the toner removing fins 125B are displaced according to the motion of the first spiral blade portion 107B, the fin ends 125BX of at least two toner removing fins 125B are pressed against the surface of the shaft portion 107A between the root portions 107BW of the first spiral blade portion 107B in the counter direction. Therefore, while the toner conveying body 107 conveys the waste toner 126 in the toner-recovery-conveying path 106A, the waste toner 126 adhering to the surface of the shaft portion 107A of the toner conveying body 107 can be certainly scraped off therefrom by the fin ends 125BX of the toner removing fins 125B of the toner removing portion 125. Accordingly, the waste toner 126 is certainly prevented from adhering to the surface of the of the shaft portion 107A of the toner conveying body 107.

Further, the toner removing portion 125 is so configured that the toner removing fins 125B are divided by the V-shaped slits 125S and have trapezoid shapes such that the widths of the end portions (i.e., the fin ends 125BX) are narrower than the root portions 125BW. Therefore, the toner removing fin 125B has restorability. Thus, while the toner conveying body 107 rotates in the toner-conveying-rotating direction in the toner-recovery-conveying path 106A, even when the toner removing fins 125B are displaced away from the surface of the shaft portion 107A according to the motion of the first spiral blade portion 107B, the toner removing fins 125B can easily and certainly return to their original positions where the fin ends 125BX of the toner removing fins 125B are pressed against the surface of the shaft portion 107A. Further, since the V-shaped slits 125S are formed between the toner removing fins 125B, intervals between the toner removing fins 125B are wider at the end portions of the toner removing fins 125B. Therefore, even if the burrs are formed on the first edge portion 125BY or the second edge portion 125BZ, the burrs are prevented from interfering with each other and prevented from hindering motions of the toner removing fins 125B.

Further, the toner removing fins 125B of the toner removing portion 125 are bent at the predetermined bending position P2. The bending position P2 is set to be a position shifted from the slit ends 125C toward the fin ends 125BX. Therefore, when the toner removing fins 125B are respectively displaced, the toner removing portion 125 is prevented from being broken off between the root portions 125BW of the toner removing fins 125B (i.e., the slit ends 125C). That is, the toner removing portion 125 is certainly prevented from being damaged. Further, even if the burrs are formed on the root portions 125BW of the toner removing fins 125B, the burrs are certainly prevented from interfering with each other and prevented from hindering motions of the toner removing fins 125B.

Further, the first edge portions 125BY of the toner removing fins 125B are pressed against the second inclined surface 107BZ of the first spiral blade portion 107B (facing the first conveying direction) when the toner conveying body 107 rotates in the toner-conveying-rotating direction. However, the first edge portion 125BY is inclined at a predetermined angle which is near the winding angle of the first spiral blade portion 107B as close as possible. Therefore, corners portion of the fin ends 125BX of the toner removing fins 125B are prevented from being damaged (i.e., flipped or crushed) even when the first edge portions 125BY of the toner removing fins 125B are pressed against the second inclined surface 107BZ of the first spiral blade portion 107B.

Further, the toner intake opening of the waste toner intake path 116A, the toner intake openings 115AY and 114AY of the toner intake paths 115A and 114A, the toner intake openings 115AY and 114AY of the toner intake paths 115A and 114A are arranged in this order in the first conveying direction. The toner intake openings 111AY, 112AY and 113AY of the toner intake paths 111A, 112A and 113A are arranged in this order in the second conveying direction. The toner removing fins 125B are provided in at least a region extending from the toner intake opening 115AY of the toner intake path 115A (for receiving the waste clear toner whose amount is the largest) to the toner ejection opening 106DX. With such a configuration, even if the amount of the waste toner 126 to be conveyed increases, it becomes possible to prevent the waste toner 126 from adhering to the surface of the shaft portion 107A of the toner conveying body 107, and to prevent decrease in the conveying capacity of the waste toner 126 without requiring a complicated configuration.

First Modification

Figure 11:
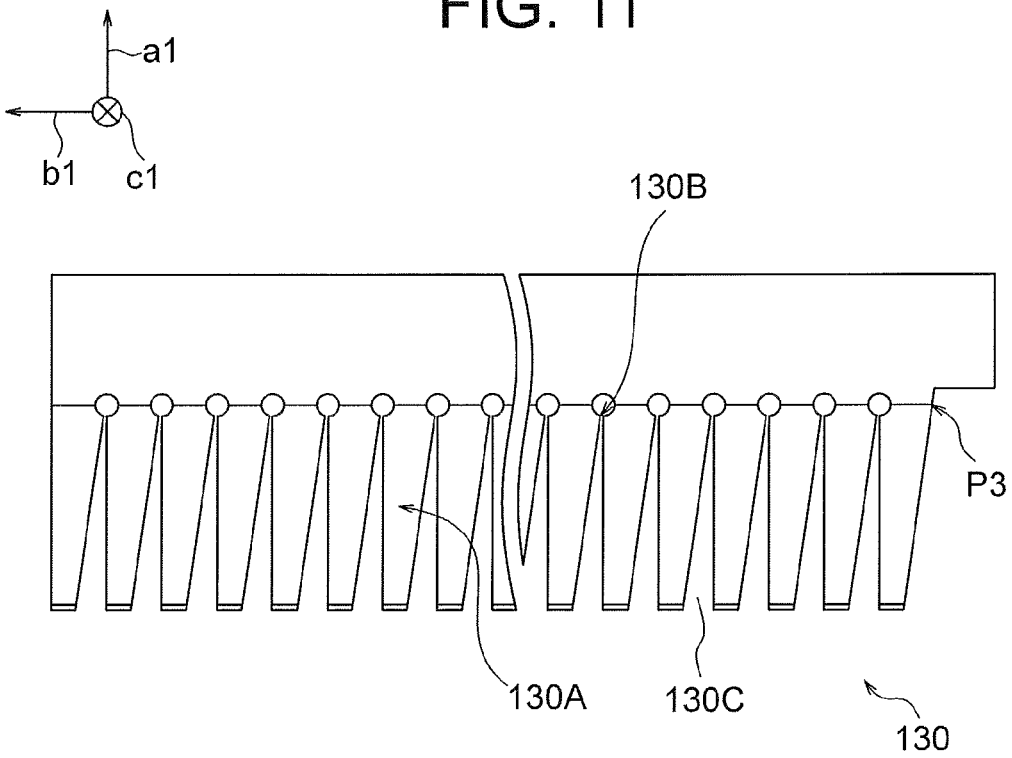
FIG. 11 is a front view showing a structure of a toner removing portion of the first modification of the first embodiment.

FIG. 11 is a front view schematically showing a toner removing portion of the first modification of the first embodiment.

In the above described first embodiment, the toner removing portion 125 includes a plurality of toner removing fins 125B divided by the V-shaped slits 125S. The toner removing fins 125B have trapezoid shapes such that the widths of the end portions (i.e., the fin ends 125BX) are narrower than the widths of the root portions 125BW. The toner removing fins 125B are bent at the bending position P2 shifted from the slit ends 125C toward the fin ends 125BX. However, the present invention is not limited to such a structure.

A toner removing portion 130 shown in FIG. 11 has circular holes 130B formed at terminal ends of V-shaped slits 130C (i.e., slit ends). Toner removing fins 130A of the toner removing portion 130 are bent at a bending position P3 corresponding to positions of the circular holes 130B. In this case, even when the toner removing fins 130A are respectively displaced during the rotation of the toner conveying body 107 in the toner-conveying-rotating direction in the toner-recovery-conveying path 106A, the toner removing portion 130 can be prevented from being broken off between the root portions of the toner removing fins 130A (i.e., the slit ends). That is, the toner removing portion 130 can be certainly prevented from being damaged. Further, the slit ends are separated from each other by the circular holes 130B, and therefore, even if burrs are formed at the root portions of the toner removing fins 130A, the burrs are prevented from interfering each other and from hindering motions of the toner removing fins 130A.

Figure 12:
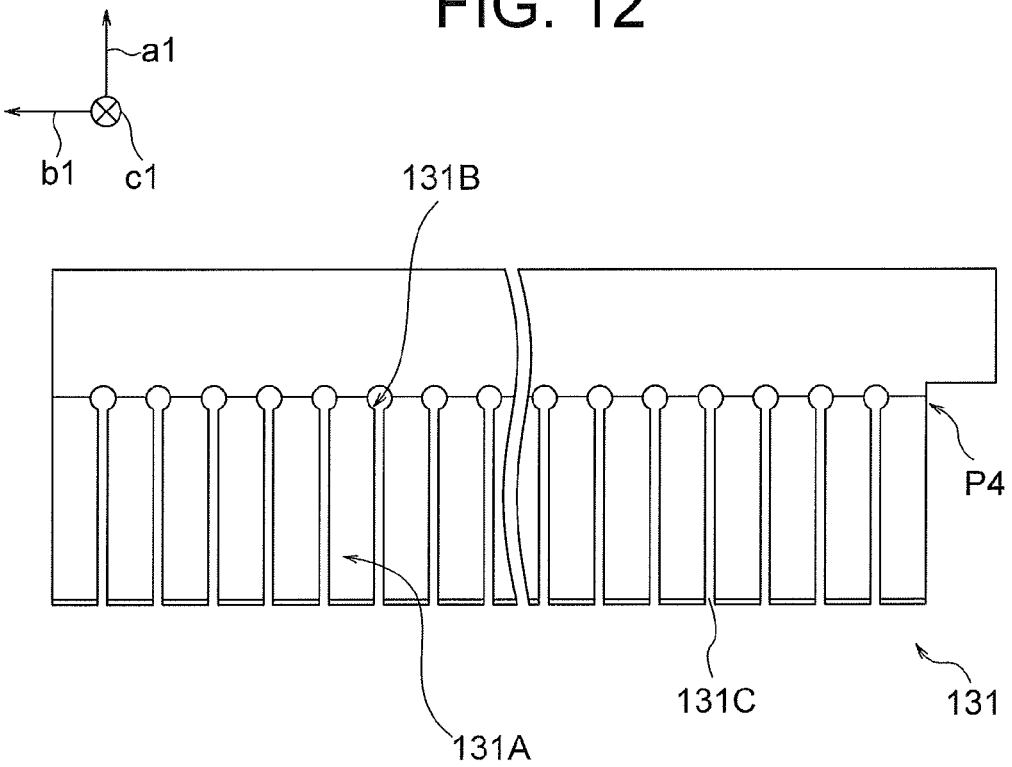
FIG. 12 is a front view showing another example of the structure of the toner removing portion of the first modification of the first embodiment.

FIG. 12 is a front view schematically showing another example of the toner removing portion of the first modification.

A toner removing portion 131 shown in FIG. 12 includes a plurality of toner removing fins 131A arranged in the removing-portion-longitudinal direction at constant intervals and divided by straight slits 131C. The toner removing fins 131A have elongated rectangular shapes. Further, circular holes 131B are formed at terminal ends of the slits (i.e., slit ends). The toner removing fins 131A are bent at a bending position P4 corresponding to positions of the circular holes 131B. In this case, even when the toner removing fins 131A are respectively displaced during the rotation of the toner conveying body 107 in the toner-conveying-rotating direction in the toner-recovery-conveying path 106A, the toner removing portion 131 can be prevented from being broken off between the root portions of the toner removing fins 131A (i.e., the slit ends). That is, the toner removing portion 130 can be certainly prevented from being damaged.

Further, it is also possible that the first edge portions 125BY of the toner removing fins 125B of the toner removing portion 125 are inclined at the same angle as the winding angle of the first spiral blade portion 107B. In this case, when the toner removing fins 125B are displaced by the motion of the first spiral blade portion 107B at the back surface, the waste toner 126 adhering to the second inclined surface 107BZ of the first spiral portion 107B can be certainly removed.

Second Modification

Figure 13A:
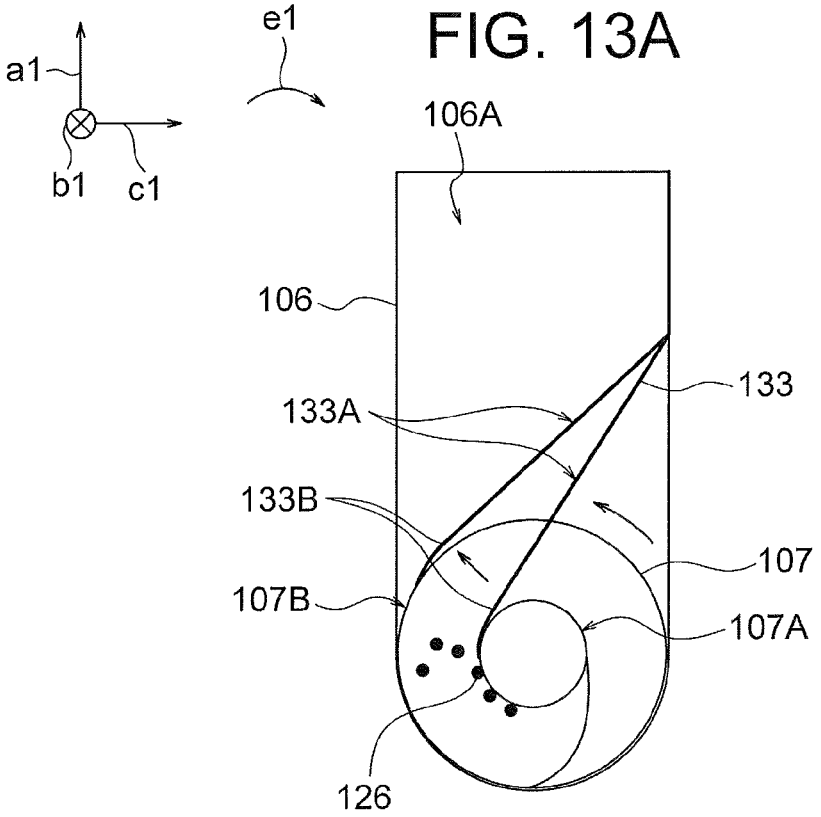
FIGS. 13A and 13B are side views showing examples of a toner removing portion of the second modification of the first embodiment.

FIG. 13A is a side view showing a toner removing portion of the second modification of the first embodiment.

In the above described first embodiment, the toner removing portion 125 includes a plurality of toner removing fins 125B having plate shapes. However, the present invention is not limited to such a structure.

A toner removing portion 133 shown in FIG. 13A includes a plurality of toner removing fins 133A having end portions 133B curved in a circular arc. A back surface of the end portions 133B of the toner removing fins 133A are pressed against the surface of the shaft portion 107A of the toner conveying body 107.

Figure 13B:
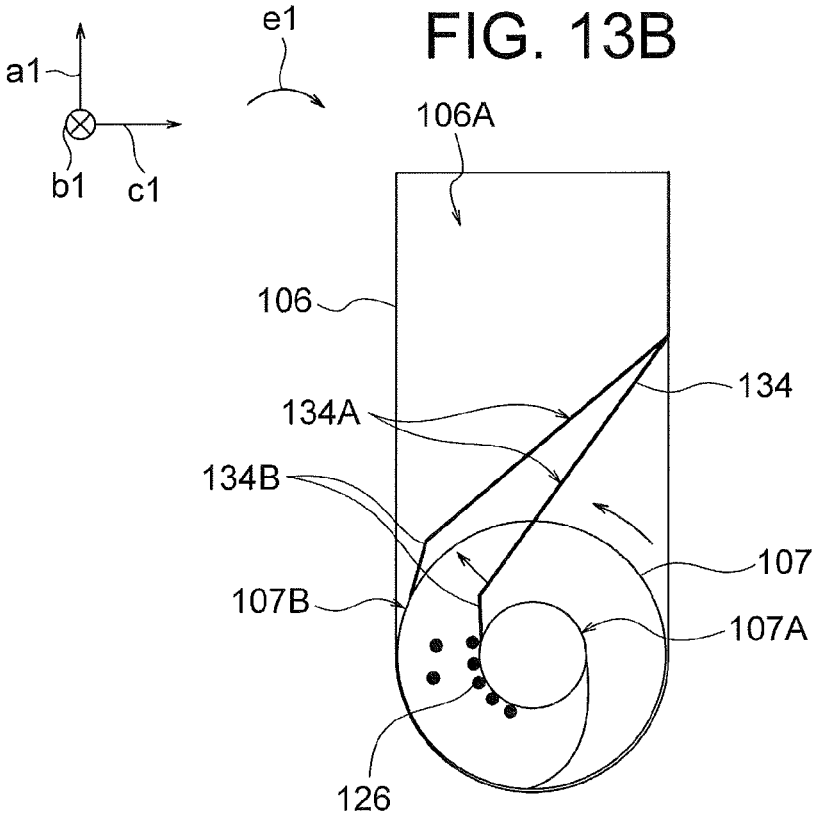

FIG. 13B is a side view showing another example of the toner removing portion of the second modification.

A toner removing portion 134 shown in FIG. 13B includes a plurality of toner removing fins 134A having end portions 134B bent at a predetermined angle. Ends (i.e., fin ends) of the toner removing fins 134A are pressed against the surface of the shaft portion 107A of the toner conveying body 107.

In such cases, the toner removing fins 133A (134A) of the toner removing portions 133 (134) can scrape off the waste toner 126 adhering to the surface of the shaft portion 107A of the toner conveying body 107. Therefore, the waste toner 126 can be prevented from adhering to the surface of the shaft portion 107A.

Third Modification

In the above described first embodiment, the toner removing portion 125 are provided in at least a region in the toner-recovery-conveying path 106A extending from the front vicinity of the concave portion 106FX to the vicinity of a position directly above the toner ejection opening 106DX. However, the present invention is not limited to such a structure.

For example, in the right side frame 100D, the conveying-path-forming portion 106 may be lowered to a level so as not to interfere with the bearing 110 for the driving roller 45 so that a height of an inner space of the conveying-path-forming portion 106 (i.e., a height of the toner-recovery-conveying path 106A) becomes constant from the front end to the rear end. In this case, the toner removing portion 125 may be provided throughout the first conveying region.

Further, the toner removing portion 125 may not only be provided in the toner-recovery-conveying path 106A, but may also be provided in the toner-ejection-conveying path of the fifth image forming unit 19 together with the toner conveying body 89 having the spiral blade portion. Further, the toner removing portion 125 may also be provided in the toner-ejection-conveying path 92 in the rear frame 100B of the transfer unit 20 together with the toner conveying body 91 having the spiral blade portion.

In such cases, in the toner-ejection-conveying path of the fifth image forming unit 19 and the toner-ejection-conveying path 92 in the rear frame 100B, the waste toner adhering to the surface of the shaft portion of the toner conveying bodies 89 and 91 can be certainly removed. Further, the toner conveying portion may be provided throughout the first conveying region and the second conveying region of the toner-recovery-conveying path 106A. This provides an advantage since there is a tendency that fluidity of the toner decreases when the toner becomes damp.

Moreover, the toner removing portions may be provided in the toner-ejection-conveying paths of the first through fourth image forming units 15, 16, 17 and 18 together with the toner conveying bodies 85, 86, 87 and 88 having the spiral blade portions. Furthermore, the toner conveying bodies with spiral blade portions may be provided in the first through fifth toner cartridges 10, 11, 12, 13 and 14 and the recovery container 108A for agitating and conveying fresh toners or the waste toner. In such a case, the toner removing portions may be provided together with the toner conveying bodies.

Fourth Modification

In the above described first embodiment, the developer conveying device of the present invention is applied to the toner conveying/recovery section 105 provided in the transfer unit 20 of the color printer 1. However, the present invention is applicable to developer conveying devices of various kinds of image forming apparatuses such as a monochrome electrophotographic printer, a multifunction printer, a facsimile, a copier, a multifunction peripheral (MFP) or the like.

Fifth Modification

In the above described first embodiment, the image forming apparatus of the present invention is applied to the color printer 1. However, the present invention is applicable to various kinds of image forming apparatuses such as the monochrome electrophotographic printer, the multifunction printer, the facsimile, the copier, the MFP or the like.

Sixth Modification

In the above described first embodiment, the waste toner 126 is described as a developer conveyed by the developer conveying body. However, the present invention is not limited to such an example. For example, various kinds of developers such as a fresh toner, and a developer in which carriers (such as ferrite or iron) are added to toner particles may be employed.

Seventh Modification

In the above described first embodiment, the toner conveying body 107 is described as an example of the developer conveying body including the shaft portion and the spiral blade portion provided on the surface of the shaft portion and being rotatable in the predetermined developer conveying rotating direction about the shaft portion. However, the present invention is not limited to such an example. For example, it is possible to employ various kinds of developer conveying bodies such as a toner conveying body including only one of the first spiral blade portion 107B and the second spiral blade portion 107C to convey the fresh toner or the waste toner only in one direction.

Eighth Modification

In the above described first embodiment, the toner removing portion 125 is described as an example of the developer removing portion having developer removing fins pressed against the surface of the shaft portion of the developer conveying body in the counter direction with respect to the developer conveying rotating direction. However, the present invention is not limited to such an example. Various kinds of developer removing portions may be employed, as long as the developer removing portion has at least one developer removing fin pressed against the surface of the shaft portion of the developer conveying body in the counter direction. For example, a toner removing portion having only one toner removing fin, or a toner removing portion having a plurality of toner removing fins arranged at arbitrary intervals via slits of various shapes may be employed.

Ninth Modification

In the above described first embodiment, the toner intake openings 115AY and 114AY of the toner intake paths 115A and 114A and the toner intake opening of the toner intake path 116A are described as examples of a plurality of intake openings for receiving the respective developers and arranged along the direction in which the developer is conveyed by the developer conveying body. However, the present invention is not limited to such an example. Various kinds of intake openings may be employed. For example, the toner intake openings 111AY, 112AY and 113AY of the first through third toner intake openings 111A, 112A and 113A may be employed.

Tenth Modification

In the above described first embodiment, the toner ejection opening 106DX provided at the center portion of the bottom surface 106D of the toner-recovery-conveying path 106A is described as an example of the ejection opening for ejecting the developer conveyed by the developer conveying body. However, the present invention is not limited to such an example. Various kinds of ejection openings may be employed. For example, a toner ejection opening provided at a front end or a rear end of the toner-recovery-conveying path 106A may be employed.

The present invention is applicable to a developer conveying device provided in an image forming apparatus such as a monochrome electrophotographic printer, a multifunction printer, a facsimile, a copier and the MFP, and is applicable to the image forming apparatus.

While the preferred embodiments of the present invention have been illustrated in detail, it should be apparent that modifications and improvements may be made to the invention without departing from the spirit and scope of the invention as described in the following claims.

What is claimed is:

1. A developer conveying device comprising:

a rotatable developer conveying body including a shaft portion and a blade portion provided on the shaft portion for conveying a developer; and a developer removing portion including:

a removing-portion-main body;

a developer removing fin supported by the removing-portion-main body and being bent at a bending position, the developer removing fin contacting the developer conveying body in a counter direction with respect to a rotating direction of the developer conveying body; and a slit extending along the developer removing fin to reach the removing-portion-main body, the slit having a closed end which is located at a position shifted from the bending position in a direction away from a tip end of the developer removing fin, wherein a distance from the bending position to the closed end of the slit is shorter than a distance from the bending position to the tip end of the developer removing fin.

2. The developer conveying device according to claim 1, wherein the developer removing fin has a trapezoid shape such that a width of the tip end of the developer removing fin is narrower than a root portion of the developer removing fin.

3. The developer conveying device according to claim 1, wherein the developer removing fin has a first edge portion facing in a direction opposite to a conveying direction of the developer;

wherein the blade portion is in the form of a spiral wound around the shaft portion; and wherein the first edge portion is inclined at an angle according to a winding angle of the blade portion.

4. The developer conveying device according to claim 1, wherein the slit includes slits, and the developer removing fin includes a plurality of developer removing fins that are provided at constant intervals via the slits, and wherein ends of at least two of the developer removing fins are pressed against a surface of the shaft portion of the developer conveying body between adjacent root portions of the blade portion so as to be pressed against the surface in a direction counter with respect to the rotating direction of the developer conveying body.

5. The developer conveying device according to claim 1, further comprising:

a plurality of intake openings arranged in a conveying direction of the developer by the developer conveying body, the intake openings receiving the developer to be conveyed by the developer conveying body, and an ejection opening for ejecting the developer conveyed by the developer conveying body, wherein the developer removing portion is provided at least in a region extending between one of the intake openings and the ejection opening, a largest amount of the developer being conveyed through the region.

6. The developer conveying device according to claim 1, wherein the tip end of the developer removing fin contacts the shaft portion at a position downstream of a top position of the shaft portion in the rotating direction of the developer conveying body.

7. The developer conveying device according to claim 1, wherein the developer removing fin has an edge portion facing in a conveying direction of the developer, and wherein the edge portion extends perpendicularly to an axial direction of the developer conveying body.

8. The developer conveying device according to claim 1, wherein the tip end of the developer removing fin is part of an end portion of the developer removing fin that has a curved shape or a bent shape.

9. The developer conveying device according to claim 1, wherein the developer removing fin is formed of resin material having resiliency.

10. An image forming apparatus comprising:

the developer conveying device according to claim 1.

11. The developer conveying device according to claim 1, wherein the developer removing fin is displaceable about the bending position.

12. The developer conveying device according to claim 1, wherein an angle between the developer removing fin and a surface of the removing-portion-main body is an obtuse angle.

13. The developer conveying device according to claim 1, wherein the developer removing fin is bent at the bending position toward a surface of the removing-portion-main body, and wherein a back-surface of the removing-portion-main body is fixed to a main body of the developer conveying device.

14. The developer conveying device according to claim 1, wherein a length of an entire portion the slit between the bending position and the closed end is shorter than a length of a remaining part of the slit.

15. The developer conveying device according to claim 1, wherein in a direction perpendicular to the shaft portion, a length of the developer removing fin is greater than a length of the removing-portion-main body.

16. A developer conveying device comprising:

a rotatable developer conveying body including a shaft portion and a blade portion provided on the shaft portion for conveying a developer;

a developer removing portion having a developer removing fin that contacts the developer conveying body in a counter direction with respect to a rotating direction of the developer conveying body, wherein the developer removing portion further includes a removing-portion-main body, and further wherein the developer removing fin is supported by the removing-portion-main body and is bent at a bending position, further wherein the developer removing portion further includes a slit;

further wherein a circular hole is formed at a closed end of the slit; and further wherein the circular hole is located at the bending position.

17. A developer conveying device comprising:

a rotatable developer conveying body including a shaft portion and a blade portion provided on the shaft portion for conveying a developer;

a developer removing portion having a developer removing fin that contacts the developer conveying body in a counter direction with respect to a rotating direction of the developer conveying body;

a plurality of intake openings arranged in a conveying direction of the developer by the developer conveying body, the intake openings receiving the developer to be conveyed by the developer conveying body; and an ejection opening for ejecting the developer conveyed by the developer conveying body, wherein the developer removing portion is provided at least in a region extending between one of the intake openings and the ejection opening, a largest amount of the developer being conveyed through the region.

* * * * *